US007185717B2

(12) United States Patent
Holte et al.

(10) Patent No.: US 7,185,717 B2
(45) Date of Patent: Mar. 6, 2007

(54) DRILL BIT ASSEMBLY

(76) Inventors: Ardis L. Holte, Holte Manufacturing 181 Polk St., Eugene, OR (US) 97402; Timothy W. Conn, Holte Manufacturing 181 Polk St., Eugene, OR (US) 97402

( * ) Notice: Subject to any disclaimer, the term of this patent is extended or adjusted under 35 U.S.C. 154(b) by 257 days.

(21) Appl. No.: 10/912,432

(22) Filed: Aug. 5, 2004

(65) Prior Publication Data

US 2006/0027399 A1 Feb. 9, 2006

(51) Int. Cl.
*E21B 10/36* (2006.01)

(52) U.S. Cl. ..... 175/57; 175/171; 175/415

(58) Field of Classification Search ..... 175/57, 175/171, 334, 385, 389, 415
See application file for complete search history.

(56) References Cited

U.S. PATENT DOCUMENTS 5,511,628 A 4/1996 Holte
5,787,999 A 8/1998 Holte
5,803,192 A 9/1998 Holte
5,921,332 A * 7/1999 Spedale, Jr. ..... 175/415
5,957,226 A 9/1999 Holte
5,975,222 A 11/1999 Holte
6,035,953 A * 3/2000 Rear ..... 175/171
6,209,665 B1 4/2001 Holte
6,394,197 B1 5/2002 Holte
2004/0104050 A1* 6/2004 Jrvel et al. ..... 175/57
2006/0021801 A1* 2/2006 Hughes et al. ..... 175/385
2006/0081403 A1* 4/2006 Mattila ..... 175/385

FOREIGN PATENT DOCUMENTS

JP 9-310576 * 12/1997
JP 2001-336389 * 5/2000

* cited by examiner

*Primary Examiner*—William P. Neuder
(74) *Attorney, Agent, or Firm*—David S. Alavi

(57) ABSTRACT

A drilling apparatus comprises a casing shoe, ring bit, and center bit. The casing shoe may be connected to a casing received within the casing shoe. The ring bit is received within the casing shoe and retained at the end of the casing. The ring bit rotates relative to the casing shoe, and drills a peripheral portion of a hole. The center bit drills a central portion of the hole, and may be rotated and percussively driven to drill the hole. The center and ring bits are adapted for: engaging one another so that rotating and percussively driving the center bit also rotates and percussively drives the ring bit; engaging one another so that retracting the center bit also retracts the ring bit, casing shoe, and casing; enabling disengagement from one another and withdrawal of the center bit from the ring bit and the casing shoe.

28 Claims, 22 Drawing Sheets

DRILL BIT ASSEMBLY

BACKGROUND

The field of the present invention relates to methods and apparatus for drilling a hole in a ground formation. In particular, apparatus and methods for drilling a hole in an unconsolidated ground formation (earth, back fill, or other medium) and advancing a casing therethrough are described herein that employ a ring bit, a center bit, and a casing shoe.

A wide variety of apparatus and methods are available for drilling a hole in a ground formation. Some of these are described in:

U.S. Pat. No. 5,511,628 entitled "Pneumatic drill with central evacuation outlet" issued Apr. 30, 1996 to Ardis L. Holte;

U.S. Pat. No. 5,787,999 entitled "Drill bit with set of underreamer arms" issued Aug. 4, 1998 to Ardis L. Holte;

U.S. Pat. No. 5,803,192 entitled "Drill bit retainer for a down hole hammer assembly" issued Sep. 8, 1998 to Ardis L. Holte;

U.S. Pat. No. 5,957,226 entitled "Reverse circulation drilling system with hexagonal pipe coupling" issued Sep. 28, 1999 to Ardis L. Holte;

U.S. Pat. No. 5,975,222 entitled "Reverse circulation drilling system with bit locked underreamer arms" issued Nov. 2, 1999 to Ardis L. Holte;

U.S. Pat. No. 6,209,665 entitled "Reverse circulation drilling system with bit locked underreamer arms" issued Apr. 3, 2001 to Ardis L. Holte; and U.S. Pat. No. 6,394,197 entitled "Reverse circulation drilling system with bit locked underreamer arms" issued May 28, 2002 to Ardis L. Holte.

Each of the above-named patents are hereby incorporated by reference as if fully set forth herein.

SUMMARY

A drilling apparatus comprises a casing shoe, a ring bit, and a center bit. The casing shoe is adapted for being substantially rigidly connected to a leading end of an elongated casing in a substantially coaxial arrangement, with the leading end of the casing received within a trailing end of the casing shoe. The ring bit is mechanically retained at the leading end of the casing in a substantially coaxial arrangement with the trailing end of the ring bit received within a leading end of the casing shoe. The ring bit is rotatable relative to the casing shoe, and is adapted at its leading end for drilling a peripheral portion of a hole in a ground formation with a hole diameter sufficiently large to accommodate the casing shoe. The center bit is adapted at a leading end thereof for drilling a central portion of the hole in a ground formation, and adapted at a trailing end thereof for being rotated and percussively driven to drill the hole. The center bit and ring bit are adapted for engaging one another so that rotating and percussively driving the center bit also rotates and percussively drives the ring bit. The center bit and ring bit are adapted for engaging one another so that withdrawing the center bit from the hole also withdraws from the hole the ring bit, the casing shoe, and a casing connected to the casing shoe. The center bit and ring bit are adapted for enabling disengagement of the center bit from the ring bit and withdrawal of the center bit from the ring bit and the casing shoe. The apparatus may further comprise an elongated casing substantially rigidly connected to the casing shoe in a substantially coaxial arrangement, with the leading end of the casing received within a trailing end of the casing shoe. The casing, casing shoe, and ring bit comprise a casing assembly.

A method for drilling a hole in a ground formation comprises: i) substantially aligning at a desired hole position the casing assembly; ii) inserting a center bit through the casing and into the ring bit; iii) engaging the center bit and ring bit so that rotating and percussively driving the center bit also rotates and percussively drives the ring bit; and iv) rotating and percussively driving the center bit and the ring bit engaged therewith, thereby drilling the hole in the ground formation and driving the center bit and casing assembly into the hole. A method for drilling a hole may further comprise disengaging the center bit from the ring bit; and withdrawing the disengaged center bit from the hole and from the casing, while leaving the casing, the casing shoe, and the ring bit in the hole. Another method for drilling a hole may further comprise engaging the center bit with the ring bit so that withdrawing the center bit from the hole also withdraws the ring bit, casing shoe, and casing from the hole; and removing the center bit from the hole, thereby also removing from the hole the engaged ring bit, the casing shoe, and the casing. Another method for drilling a hole may further comprise interrupting percussive driving of the center bit before completion of the hole; during the interruption, engaging the center bit with the ring bit so that retracting the center bit within the hole also retracts the ring bit, casing shoe, and casing within the hole; during the interruption, retracting the center bit within the hole, thereby also retracting within the hole the engaged ring bit, the casing shoe, and the casing; and resuming percussive driving of the center bit.

Objects and advantages of pertaining to methods and apparatus for drilling holes in ground formations may become apparent upon referring to the disclosed embodiments as illustrated in the drawings and disclosed in the following written description and/or claims.

The embodiments shown in the Figures are exemplary, and should not be construed as limiting the scope of the present disclosure and/or appended claims. In particular, the length of the casing varies throughout the Figures, and in fact casings of widely varying lengths may be employed with the drill bit assembly as disclosed and/or claimed herein.

DETAILED DESCRIPTION OF EMBODIMENTS

Figure 1:
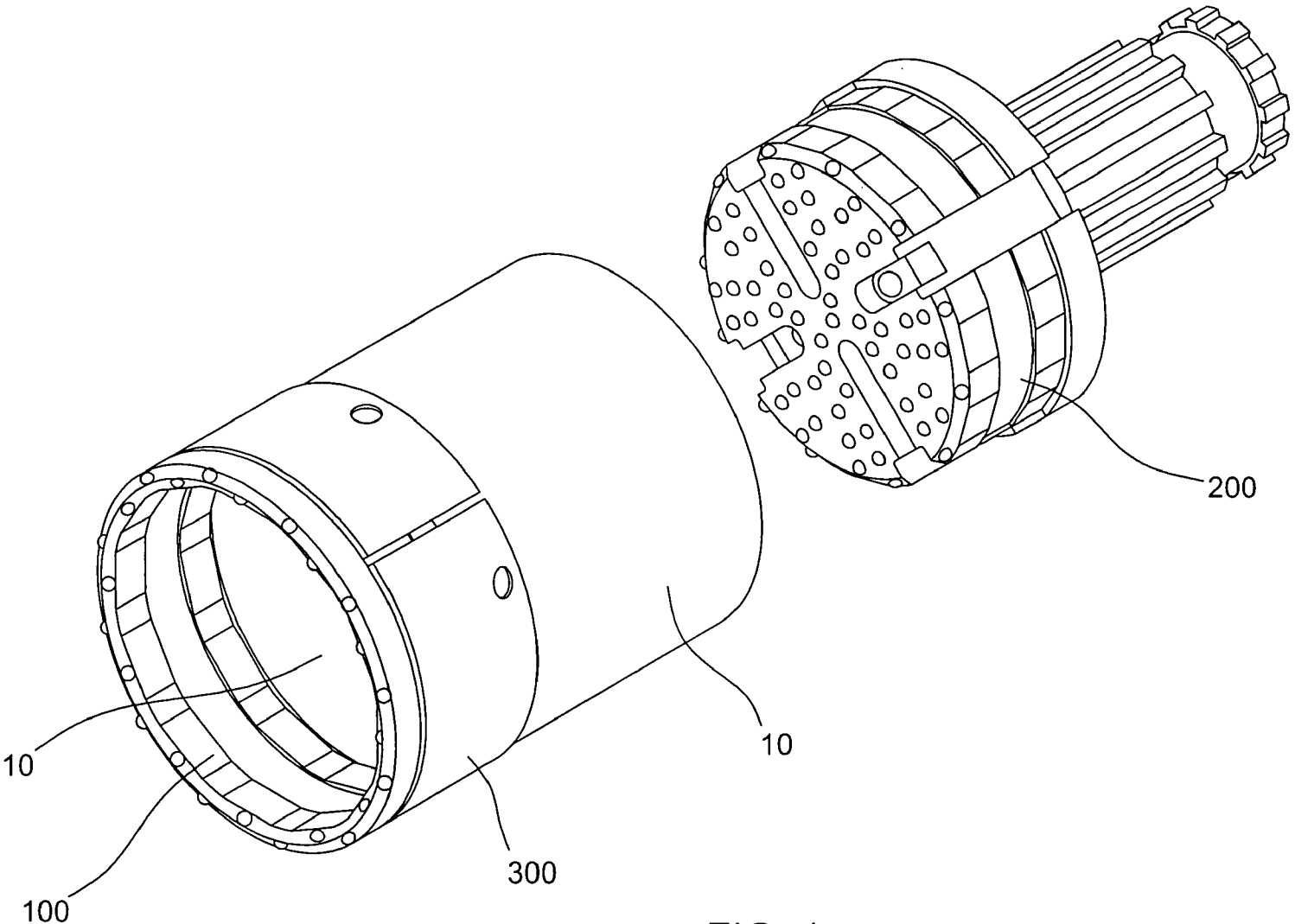
FIG. 1 is an isometric view of a casing assembly and a center bit.
Figure 2:
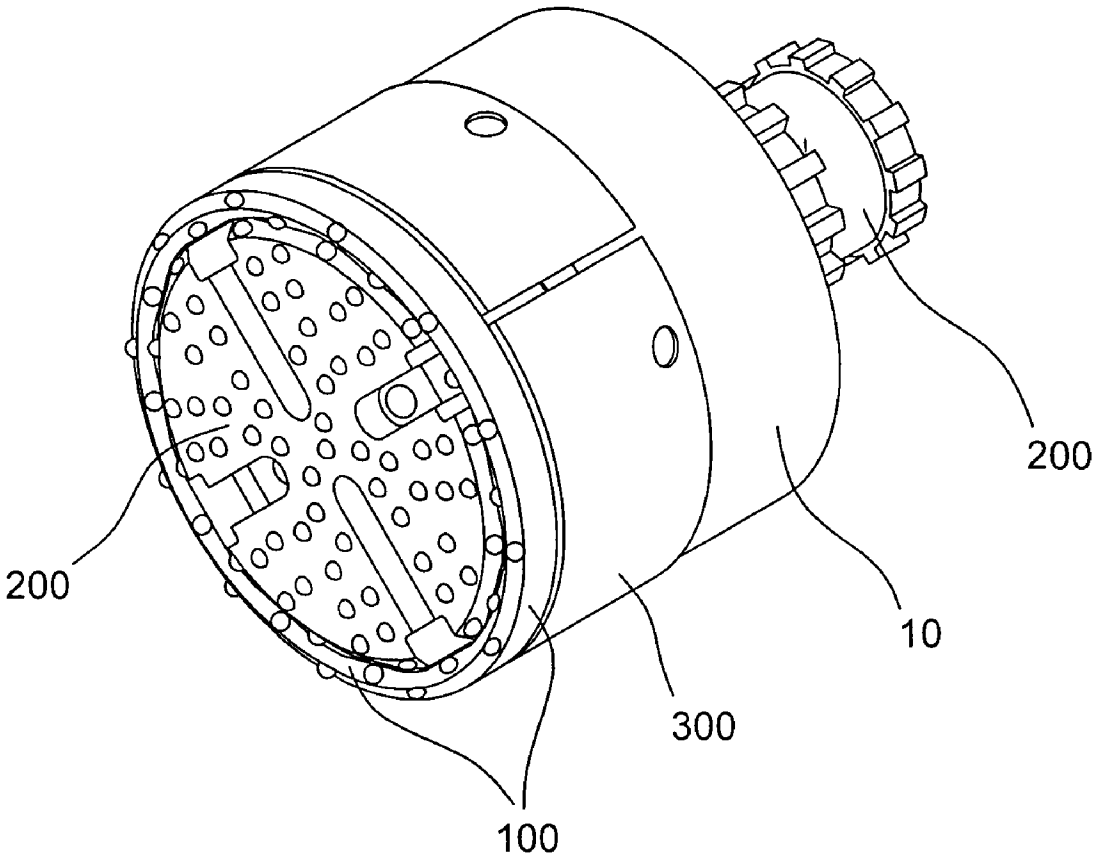
FIG. 2 is an isometric view of a center bit engaged with a casing assembly.
Figure 3:
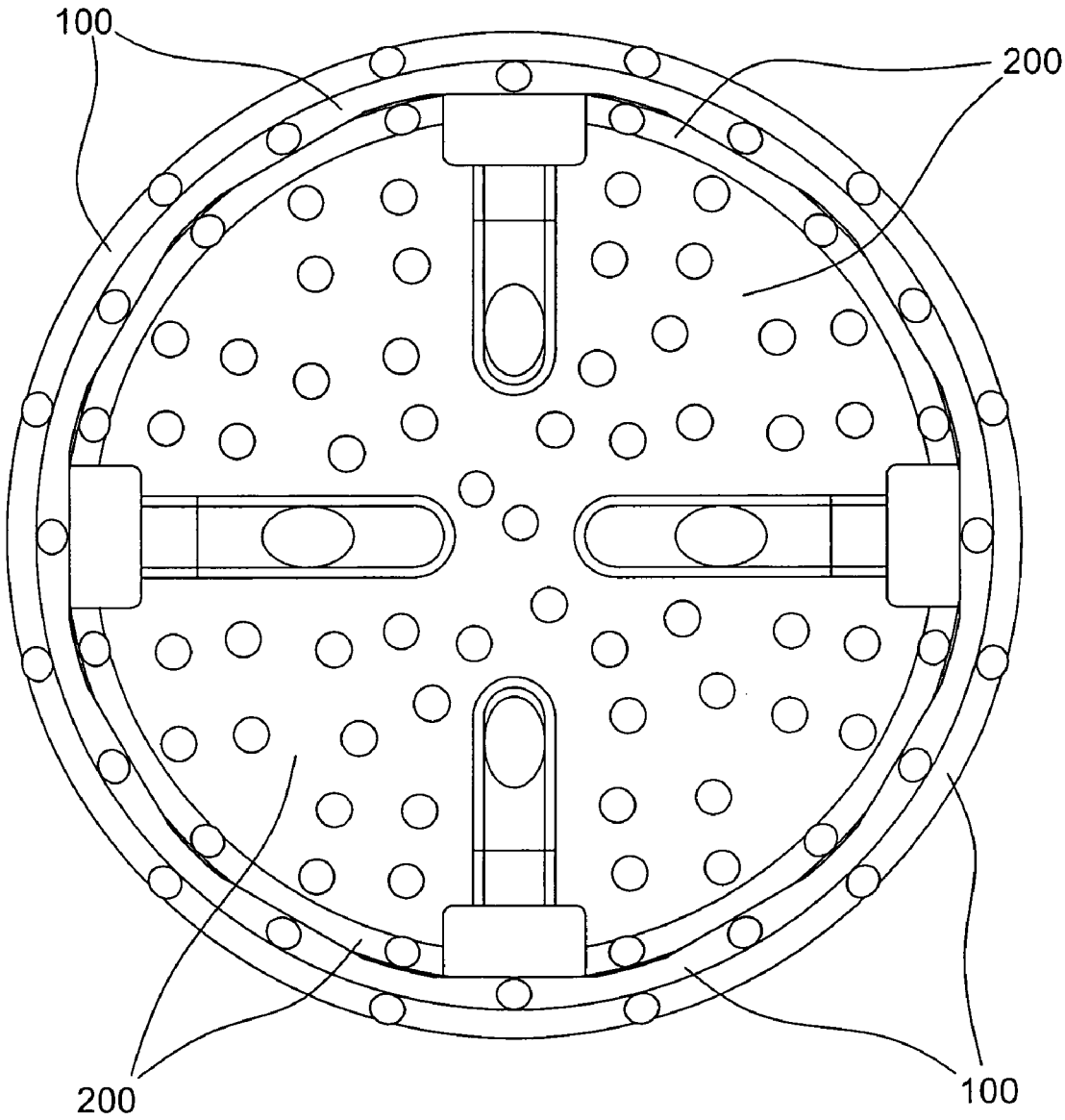
FIG. 3 is a leading end view of a center bit engaged with a casing assembly.
Figure 4:
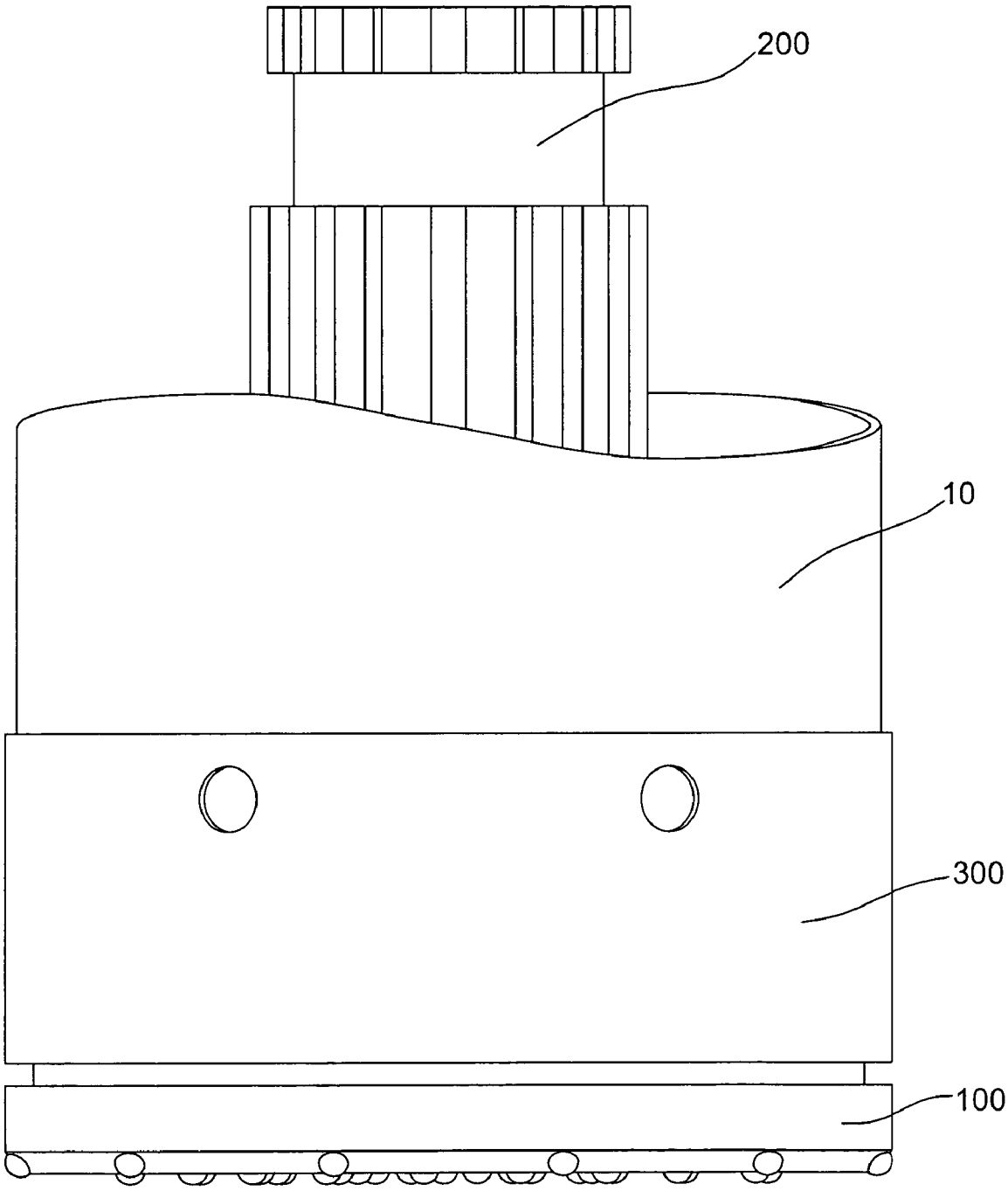
FIG. 4 is a side view of a center bit engaged with a casing assembly.
Figure 5A:
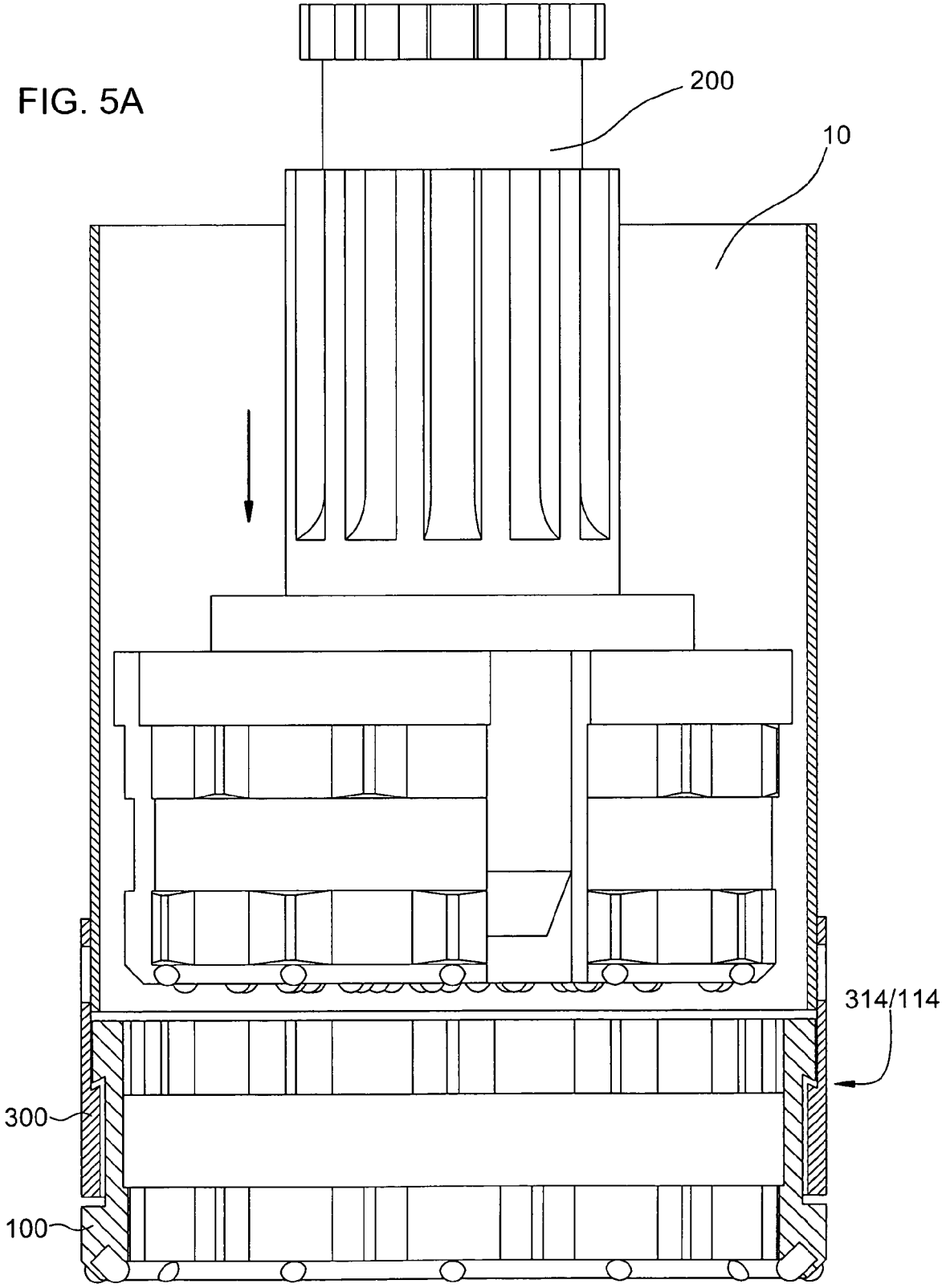
FIGS. 5A–5D are partial cross sectional views illustrating various engagements of a center bit and casing assembly.
Figure 5B:
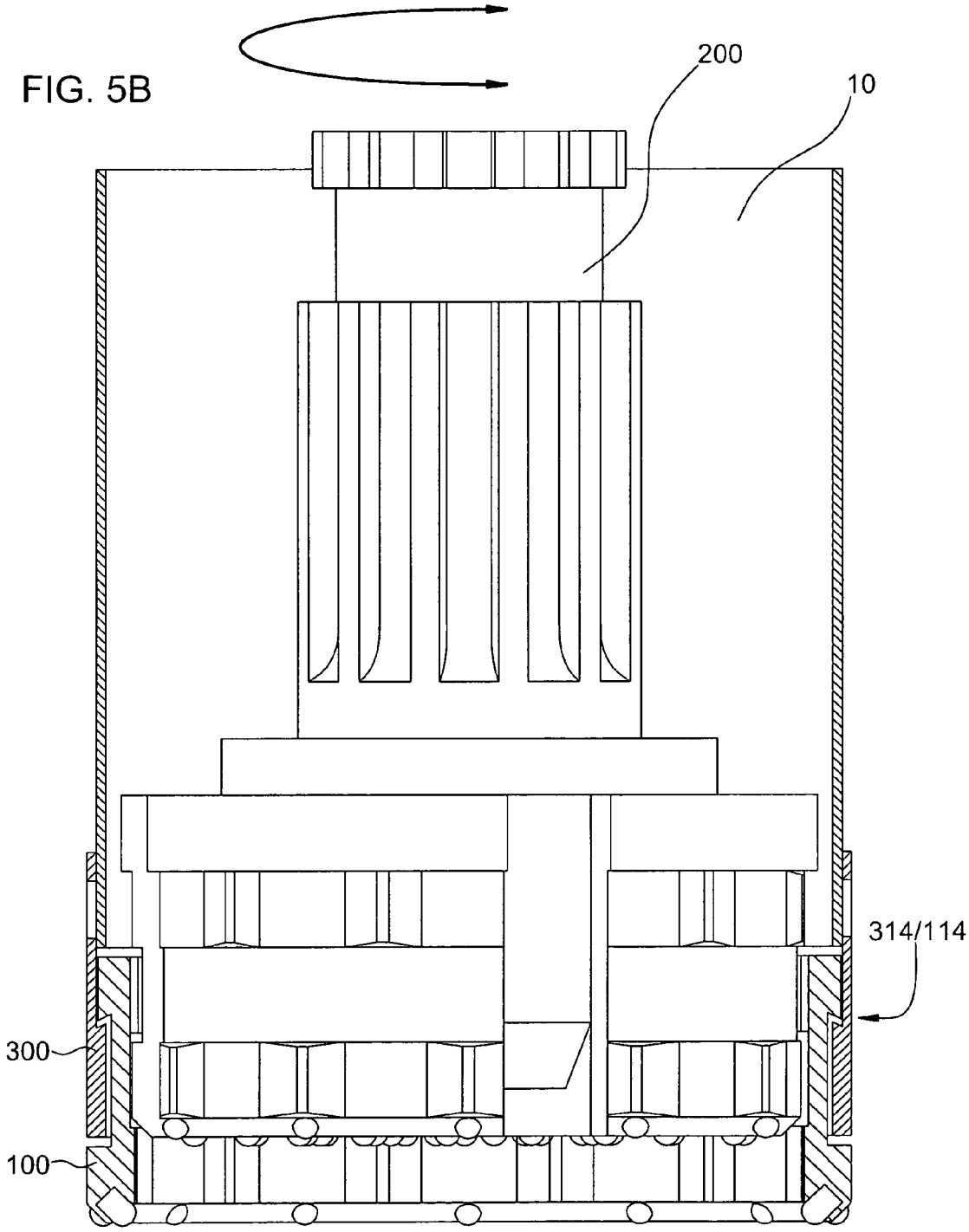
Figure 5C:
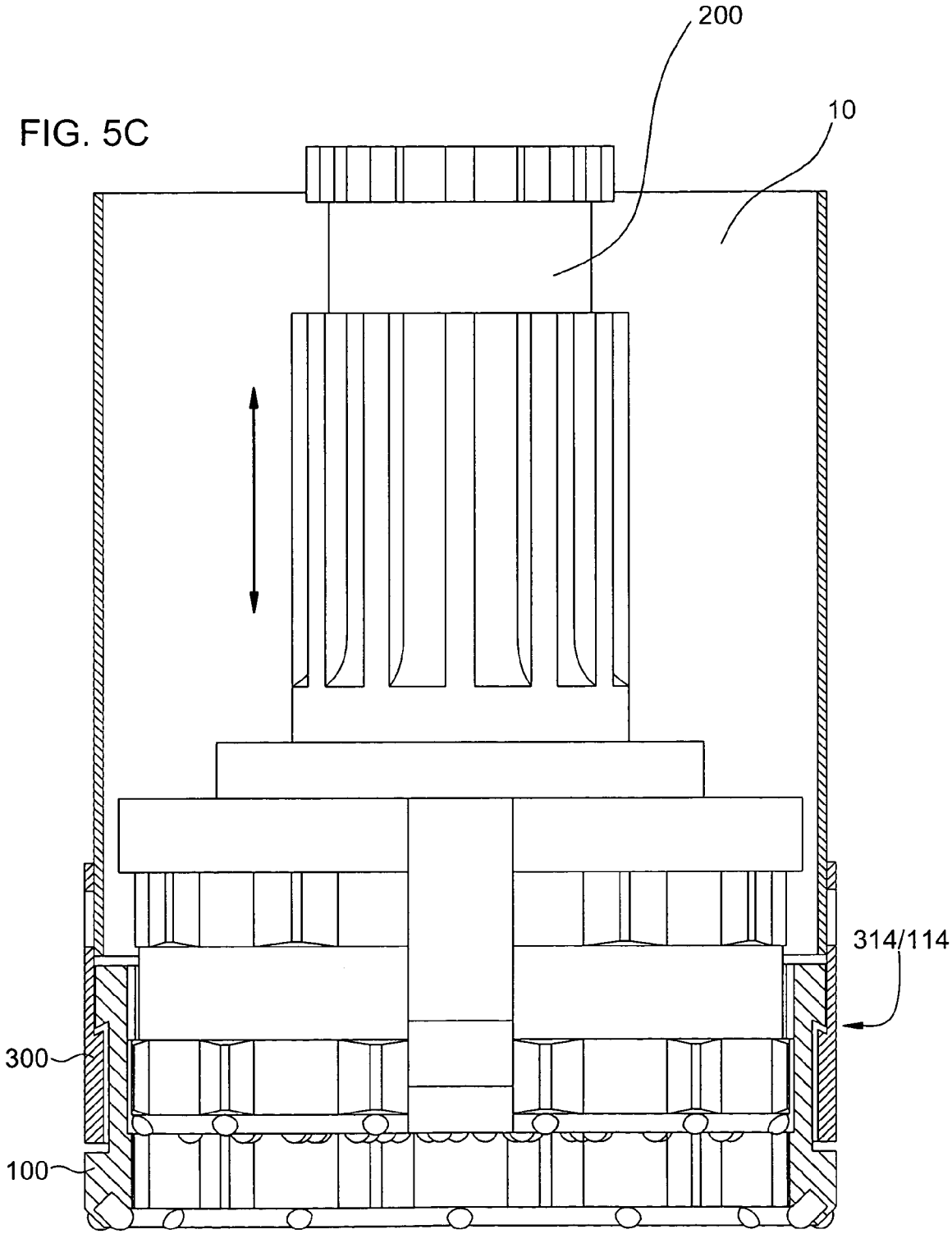
Figure 5D:
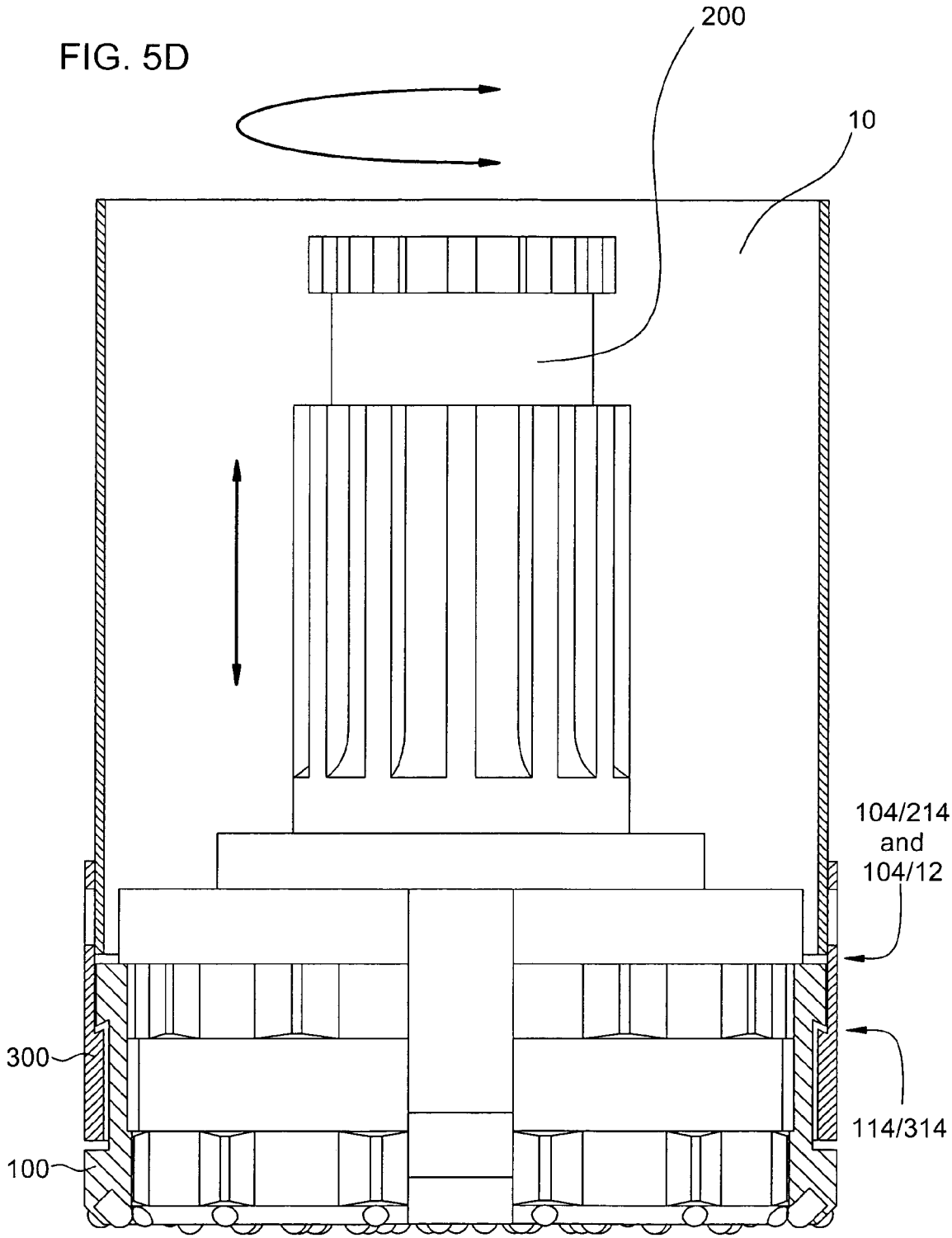
Figure 6:
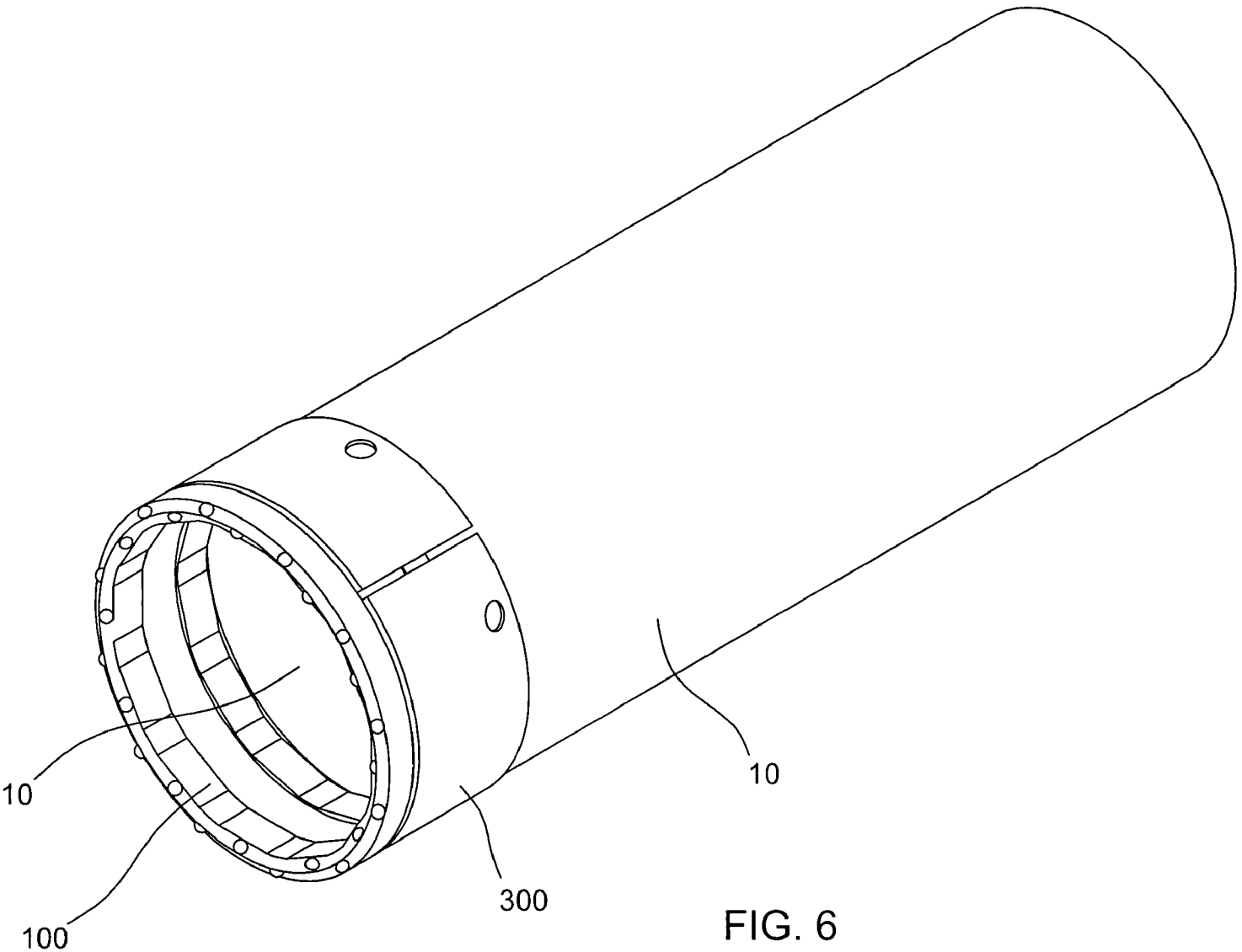
FIG. 6 is an isometric view of a casing assembly.
Figure 7:
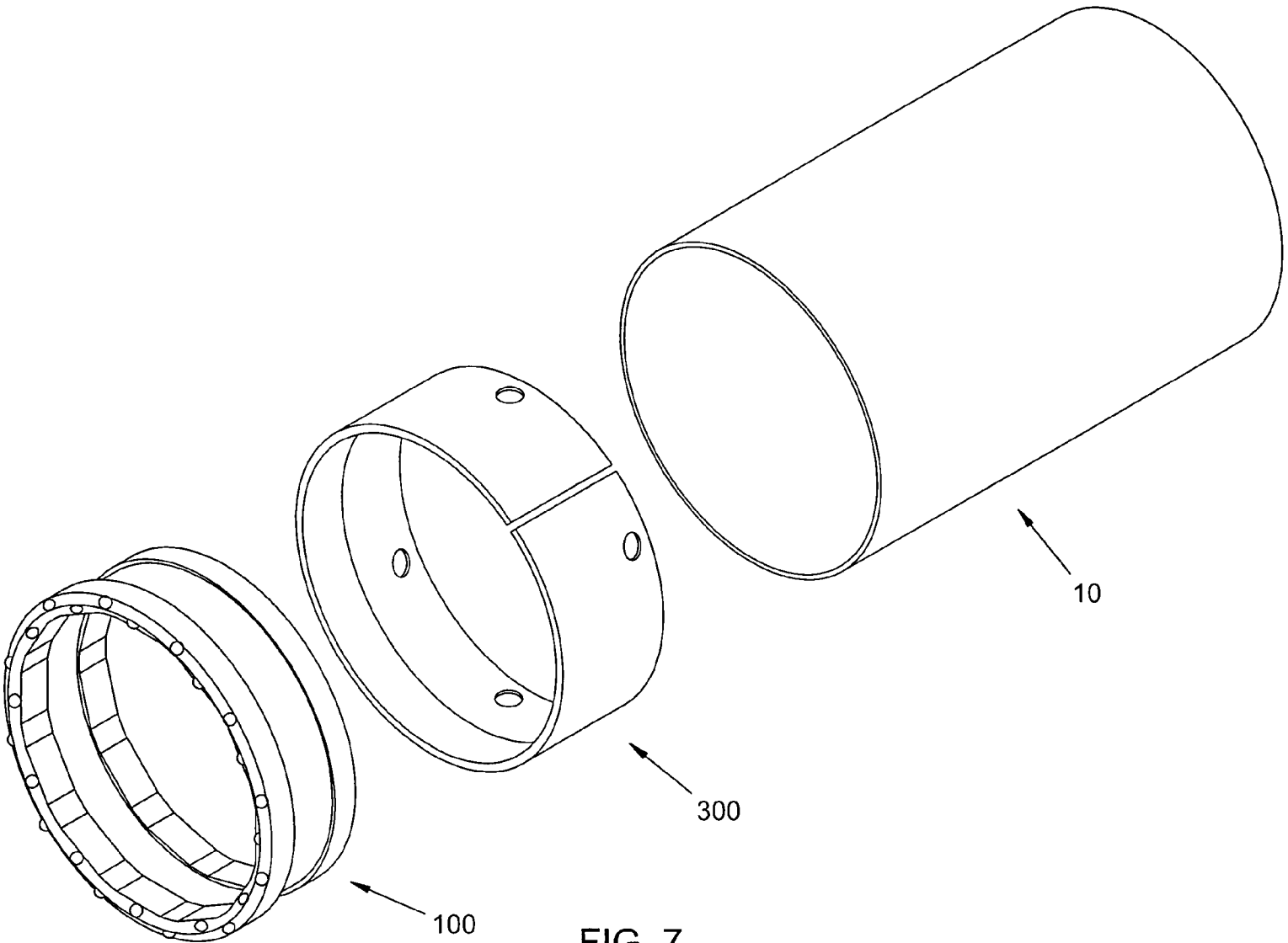
FIG. 7 is an exploded isometric view of a casing assembly.
Figure 8:
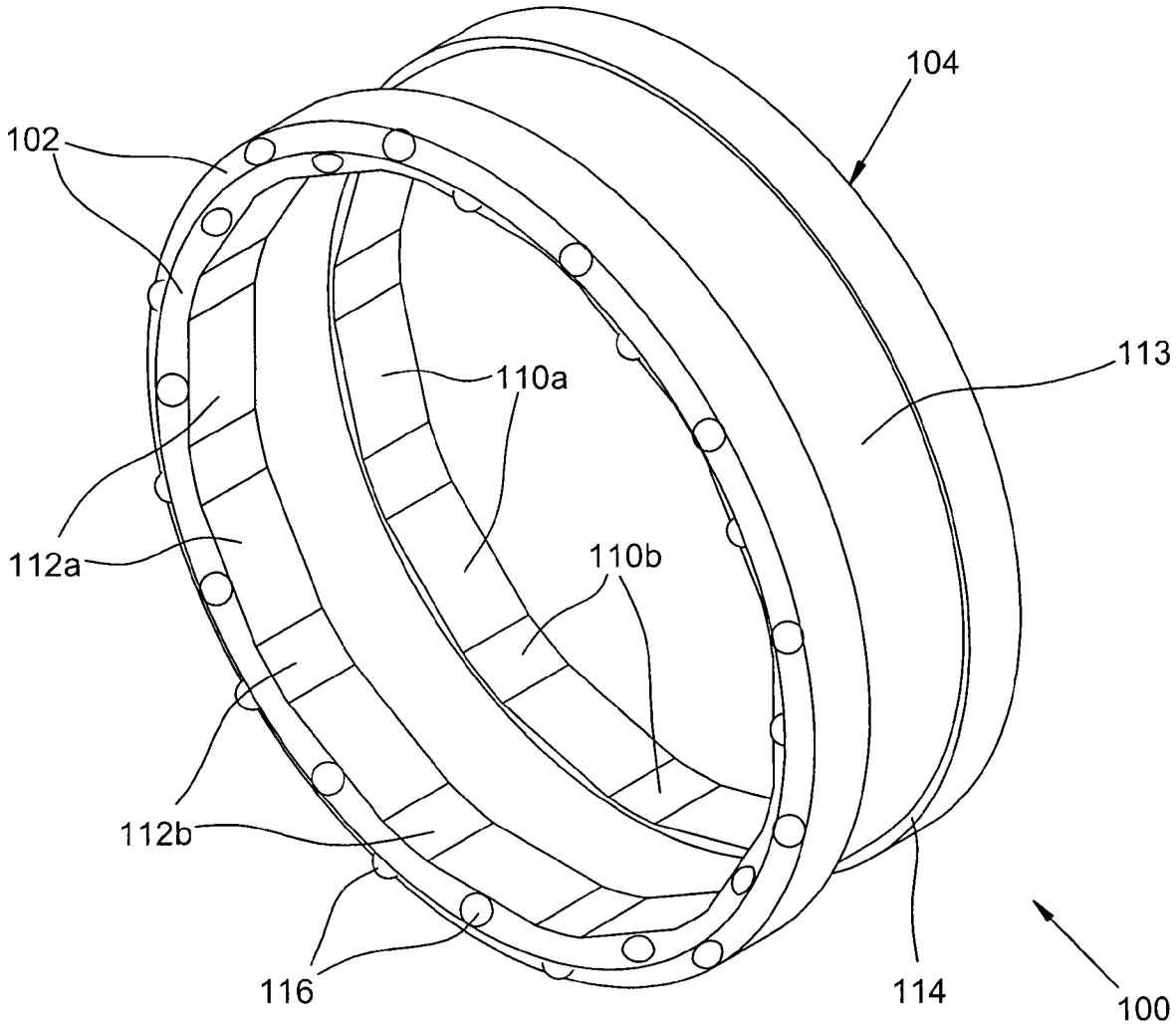
FIG. 8 is an isometric view of a ring bit.
Figure 9:
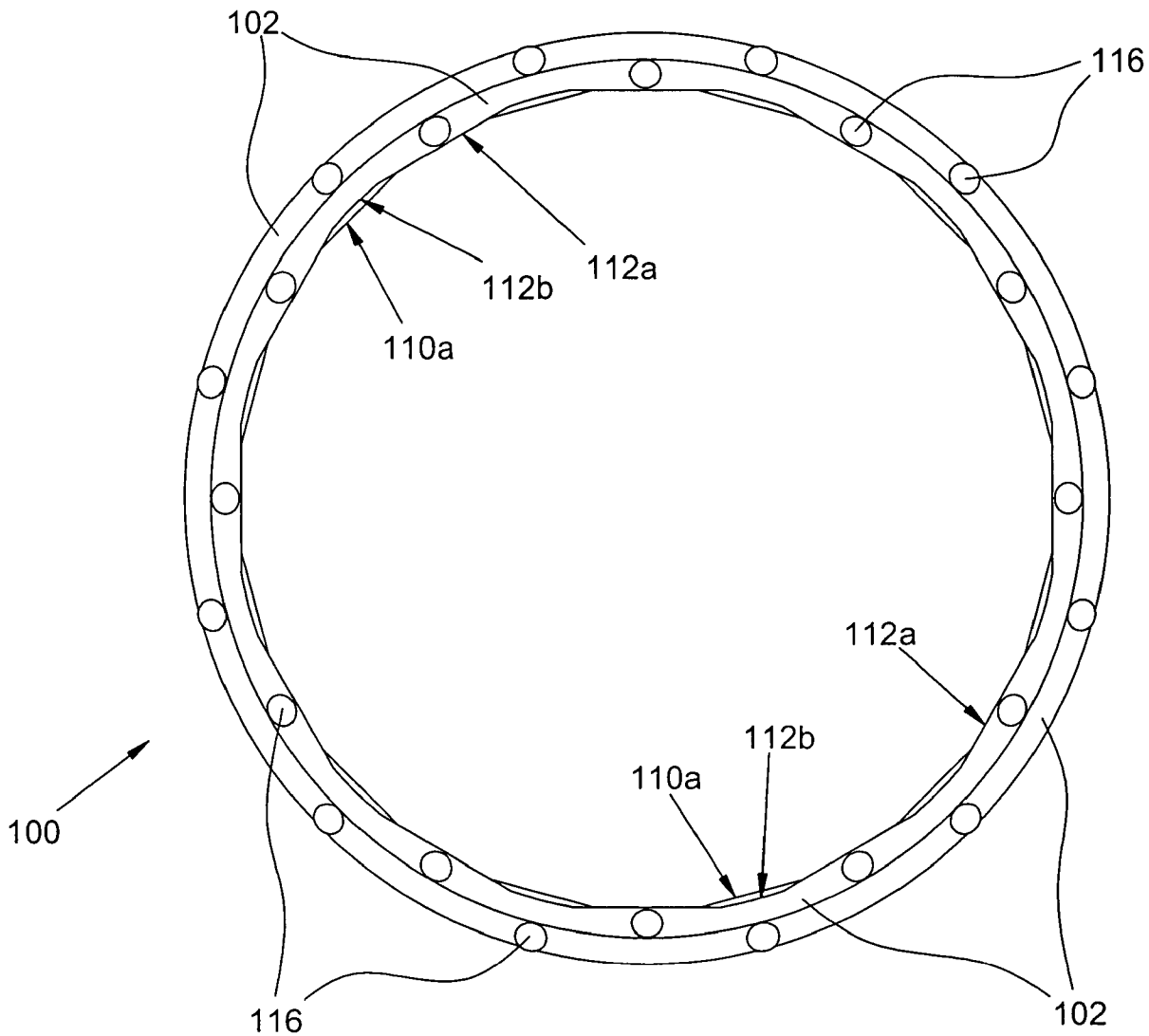
FIG. 9 is a leading end view of a ring bit.
Figure 10A:
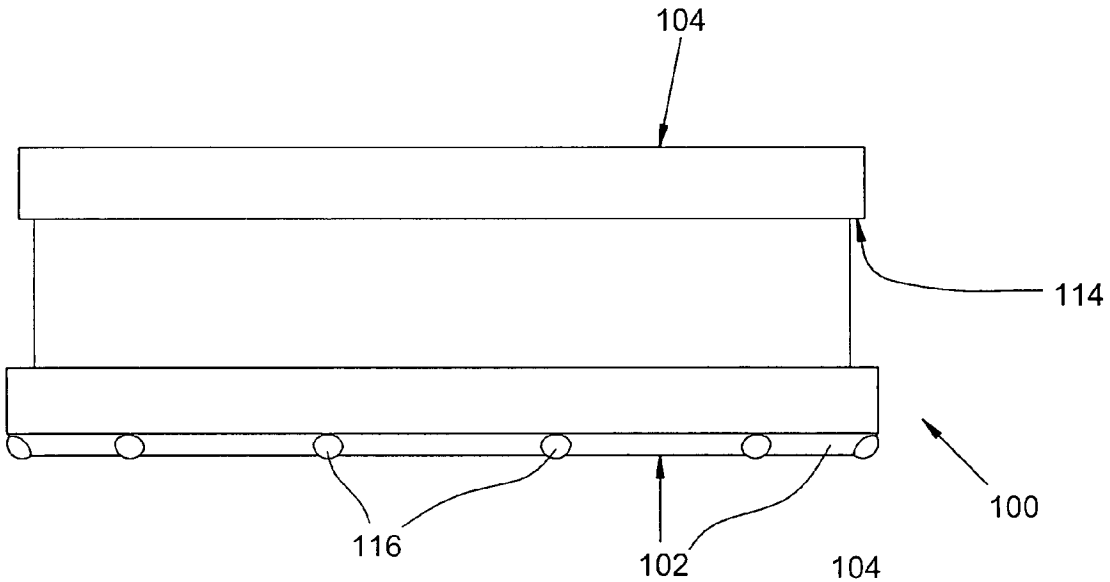
FIGS. 10A–10B are side and cross-sectional views, respectively, of a ring bit.
Figure 10B:
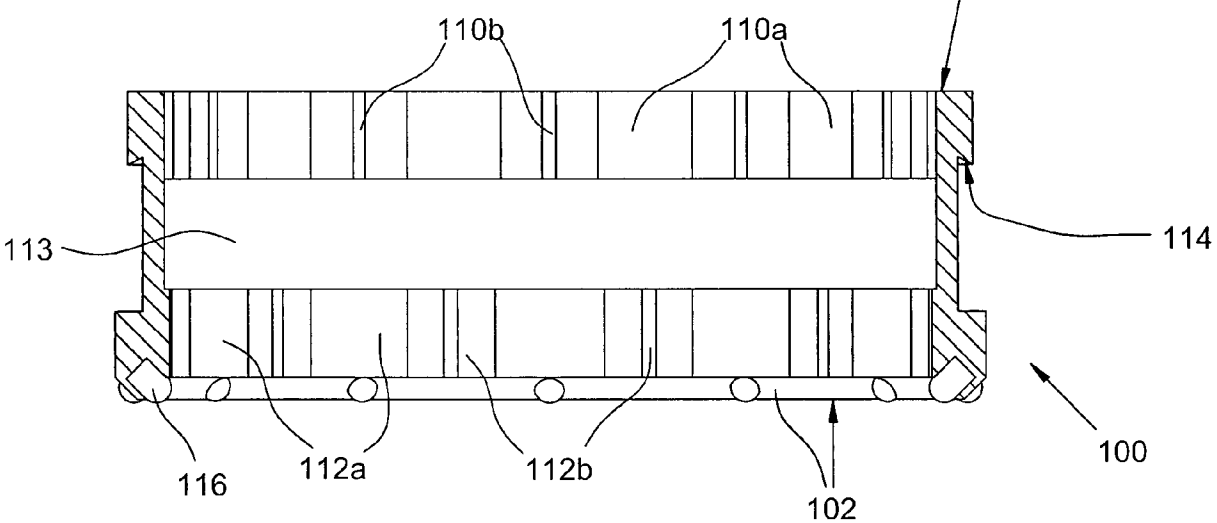
Figure 11:
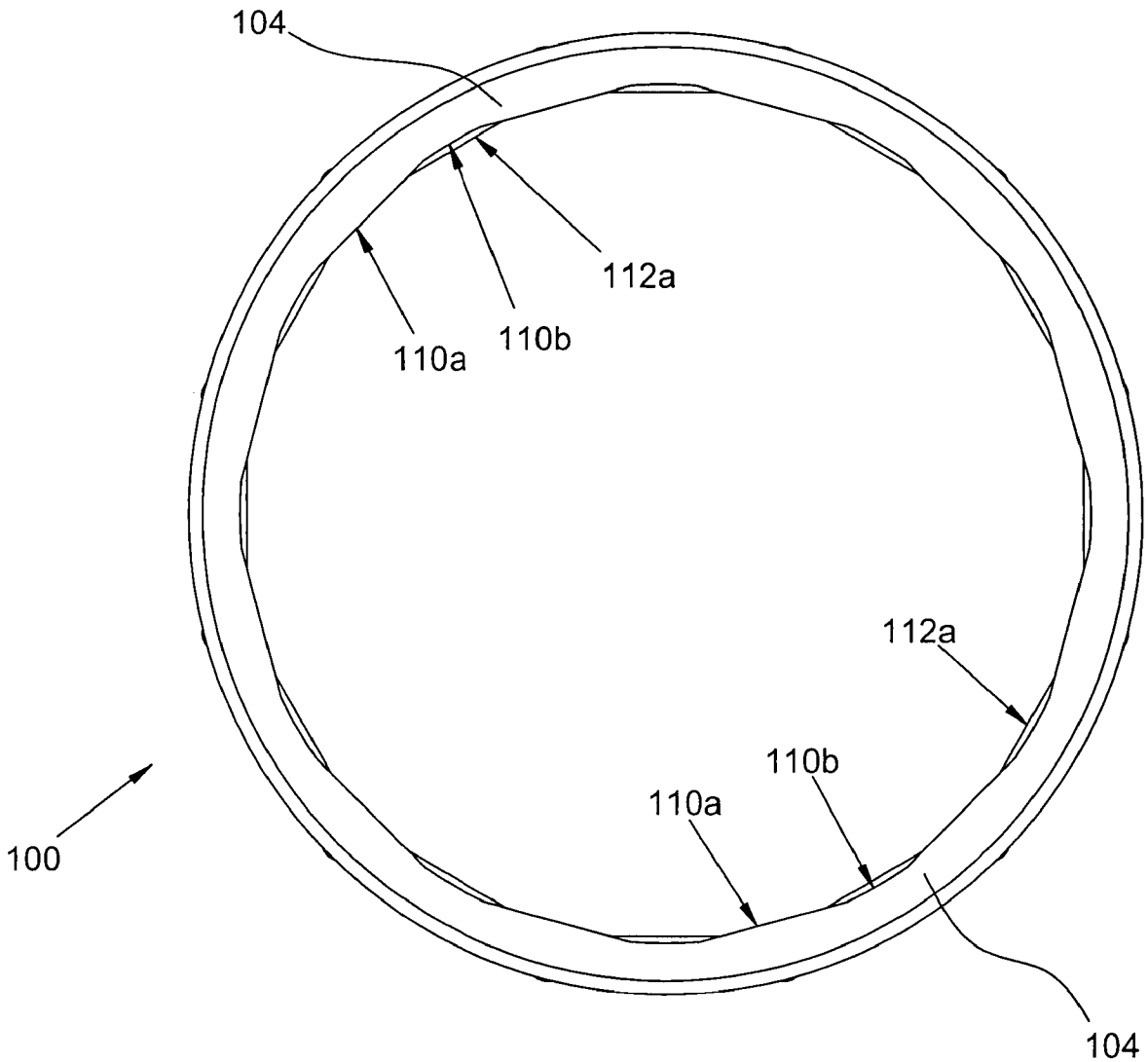
FIG. 11 is a trailing end view of a ring bit.

FIGS. 1 through 18 illustrate an exemplary drill bit assembly comprising a ring bit 100, a center bit 200, and a casing shoe 300. In many of the Figures, casing shoe 300 is shown substantially rigidly connected to the leading end 12 of an elongated casing 10 in a substantially coaxial arrangement, with the leading end 12 of the casing 10 received within a trailing end 304 of the casing shoe 300. For digging a hole in a ground formation, the ring bit 100, casing shoe 300, and casing 10 (collectively referred to as a casing assembly; FIGS. 6 and 7) is substantially aligned at a desired hole position, and the center bit 200 is inserted through the casing 10, through the casing shoe 300, and into the ring bit 100. The center bit 200 is rotated and percussively driven to drill the hole and to drive the ring bit, casing shoe, and casing into the hole, as further described hereinbelow.

The ring bit 100 is shown alone in FIGS. 8–11. The ring bit is hollow and substantially cylindrical. Leading end 102 is adapted for drilling a peripheral portion of the hole in the ground formation. In the illustrated exemplary embodiment, the leading end 102 comprise two angled annular end faces, with hardened inserts 116 (tungsten carbide compacts, for example, or any other suitable insert). The leading end 102 may instead comprise a single angled annular end face, a single flat annular end face, multiple end face segments, or any other suitable arrangement. The ring bit is sufficiently large so that the resulting hole diameter will accommodate the casing shoe 300 and the casing 10, allowing them to be driven into the hole as it is drilled. The ring bit 100 is retained by the casing shoe 300 in a substantially coaxial arrangement, with the trailing end 104 of the ring bit received within the leading end 302 of the casing shoe 300. The ring bit 100 is rotatable relative to the casing shoe 300. The particular arrangement of the ring bit (including leading end 102 and inserts 116, and trialing end 104) shown in the Figures is exemplary only, and should not be construed as limiting the scope of the present disclosure and/or appended claims; any other suitable arrangement or configuration shall also fall within the scope of the present disclosure and/or appended claims. The inner circumference of the ring bit 100 is adapted for engaging the center bit 200, as described further hereinbelow.

Figure 12:
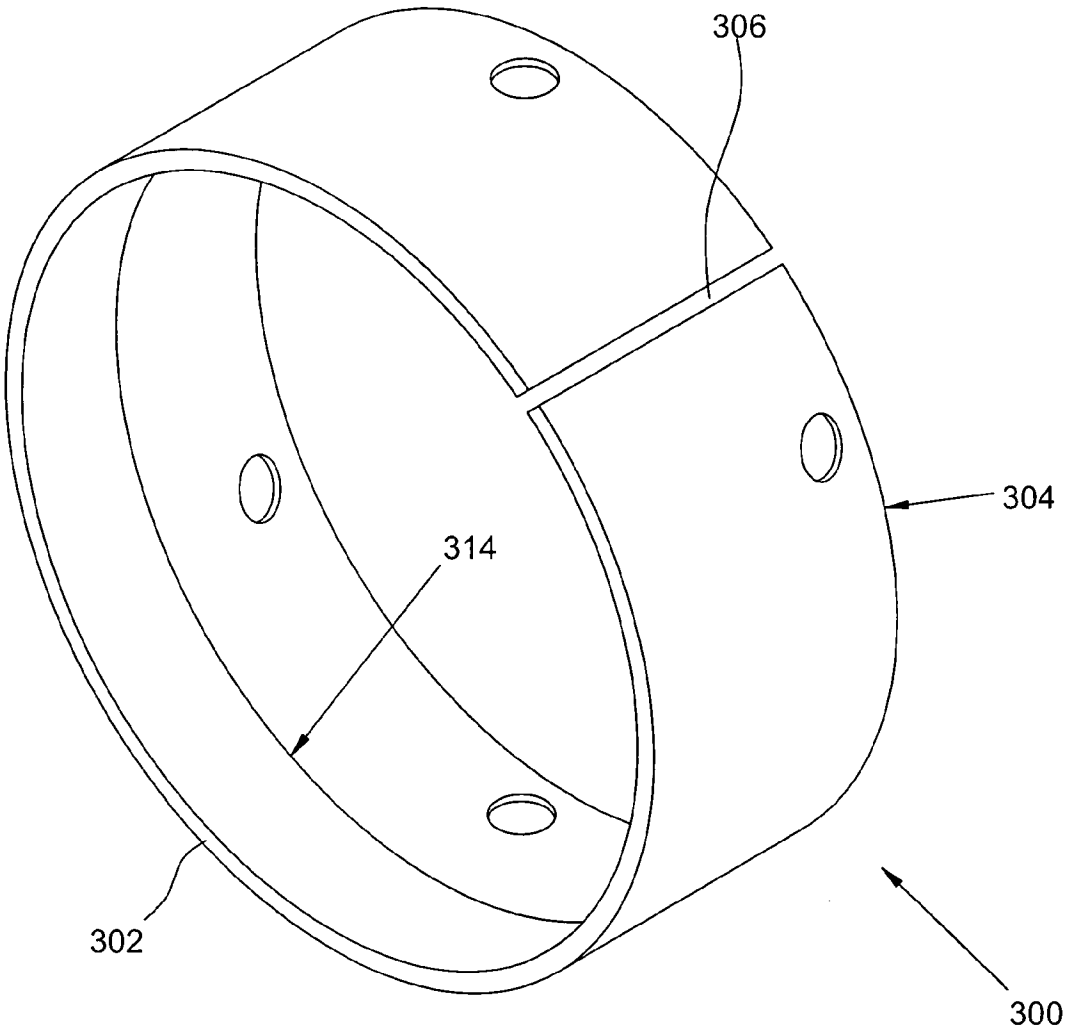
FIG. 12 is an isometric view of a casing shoe.
Figure 13:
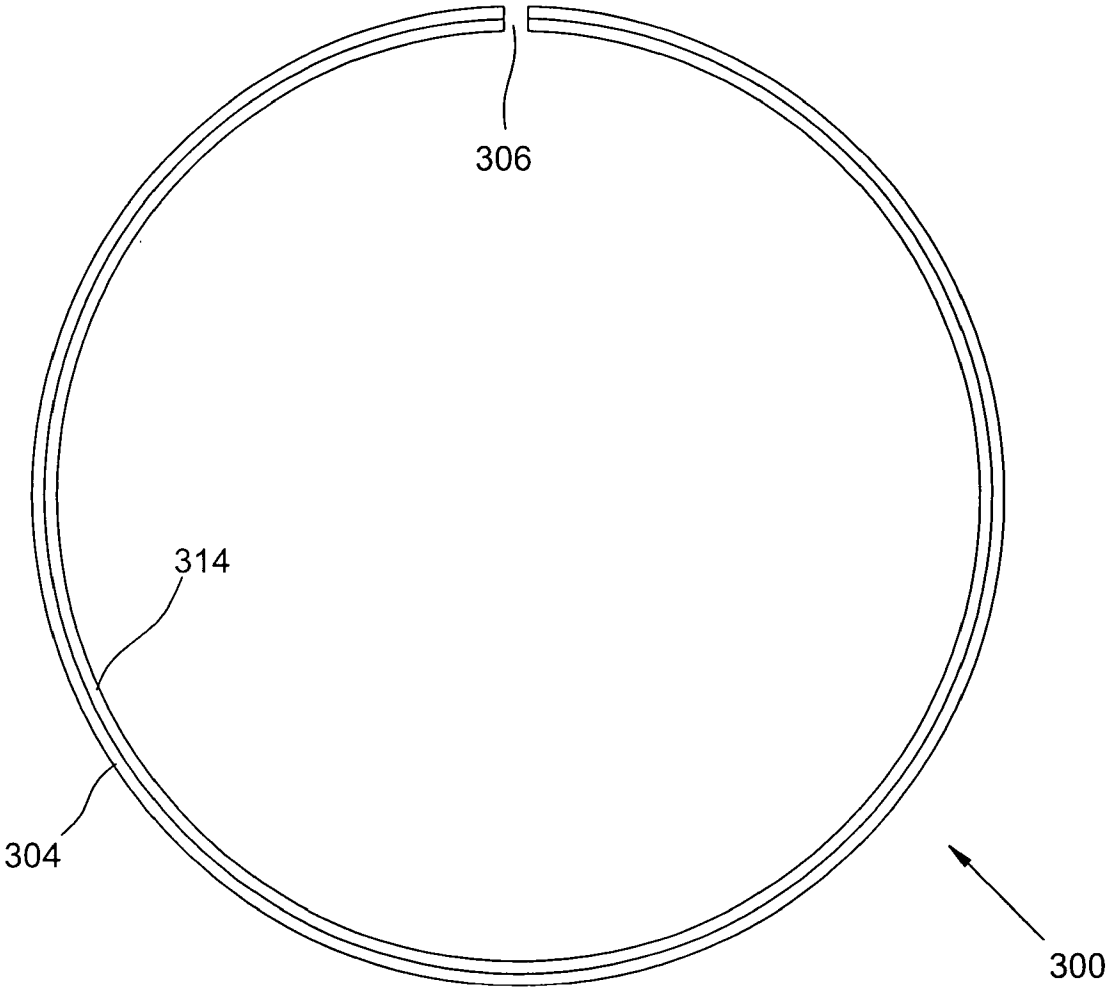
FIG. 13 is a trailing end view of a casing shoe.
Figure 14A:
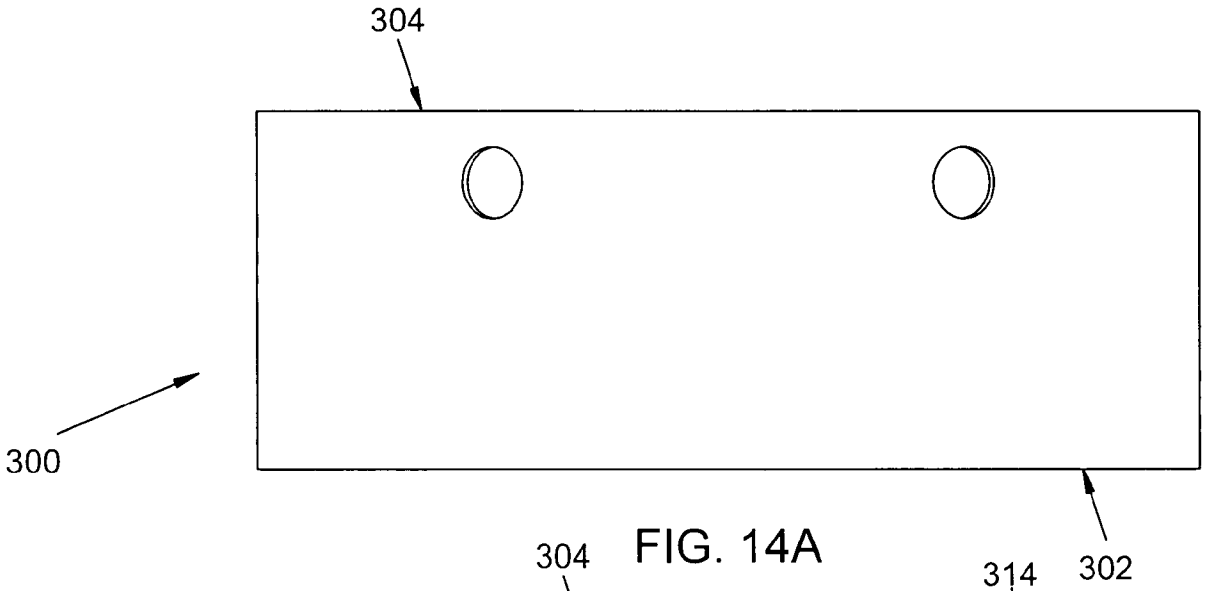
FIGS. 14A–14B are side and cross-sectional views, respectively, of a casing shoe.
Figure 14B:
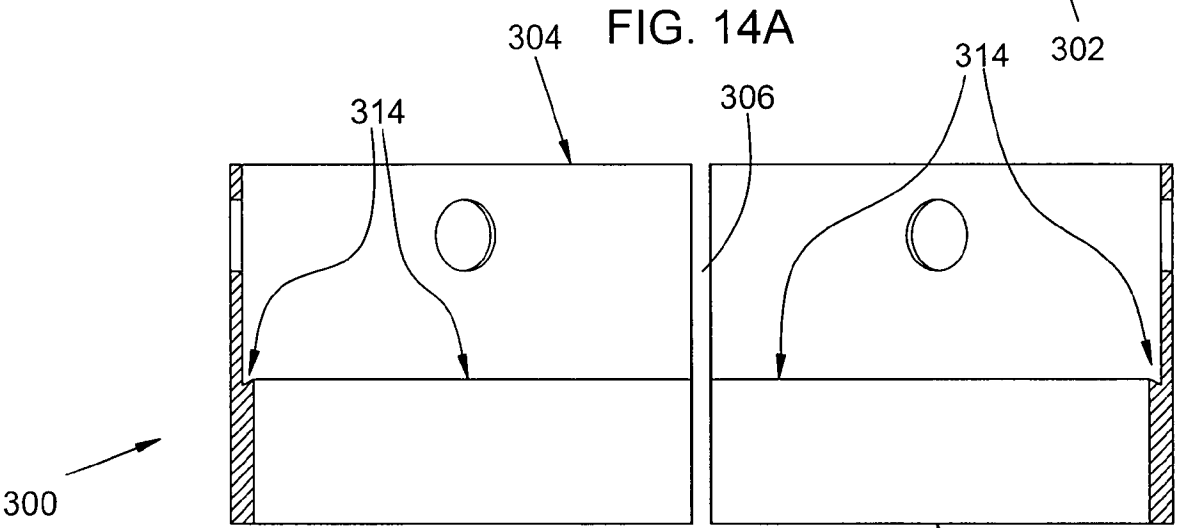
Figure 15:
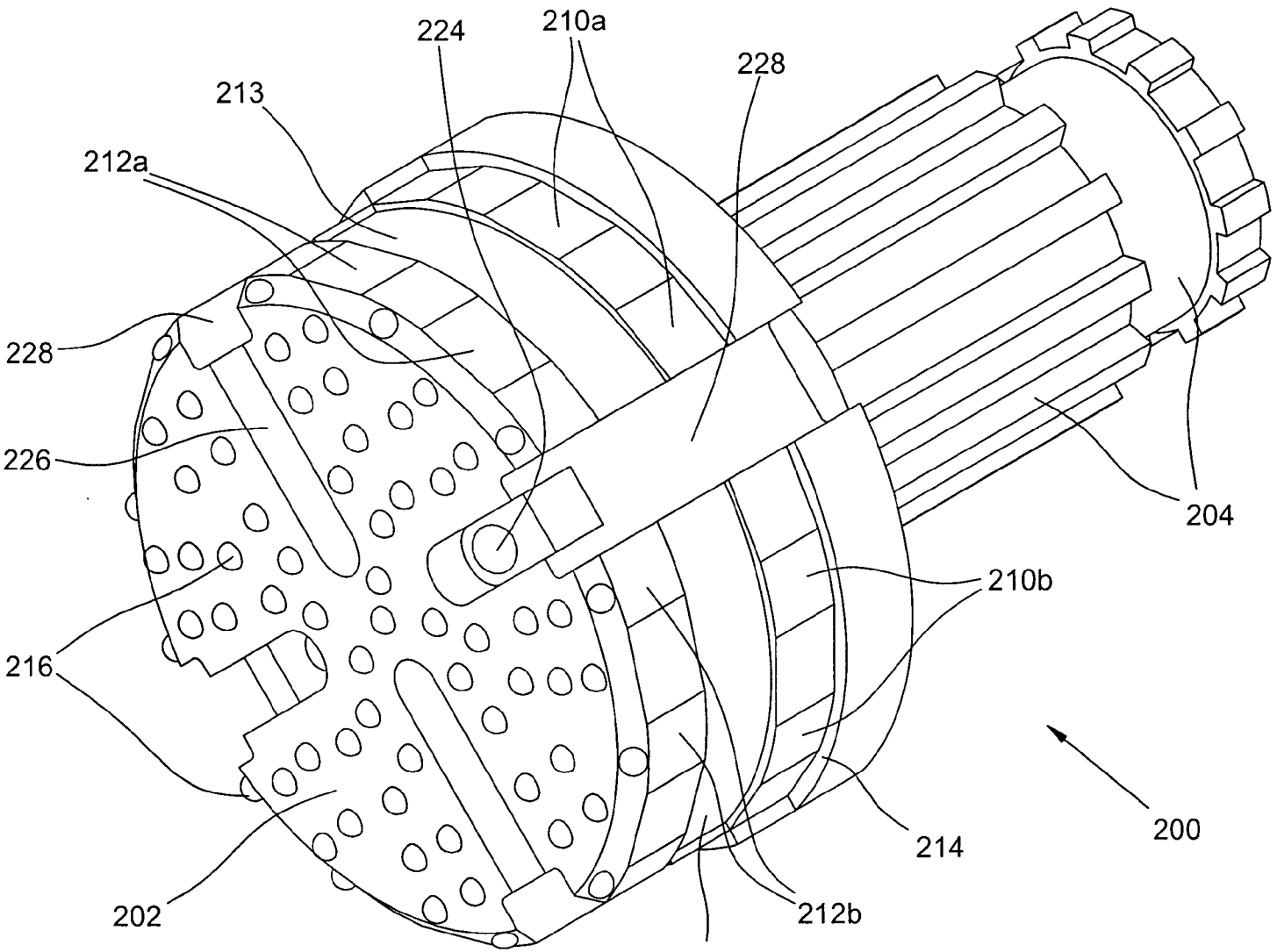
FIG. 15 is an isometric view of a center bit.
Figure 16:
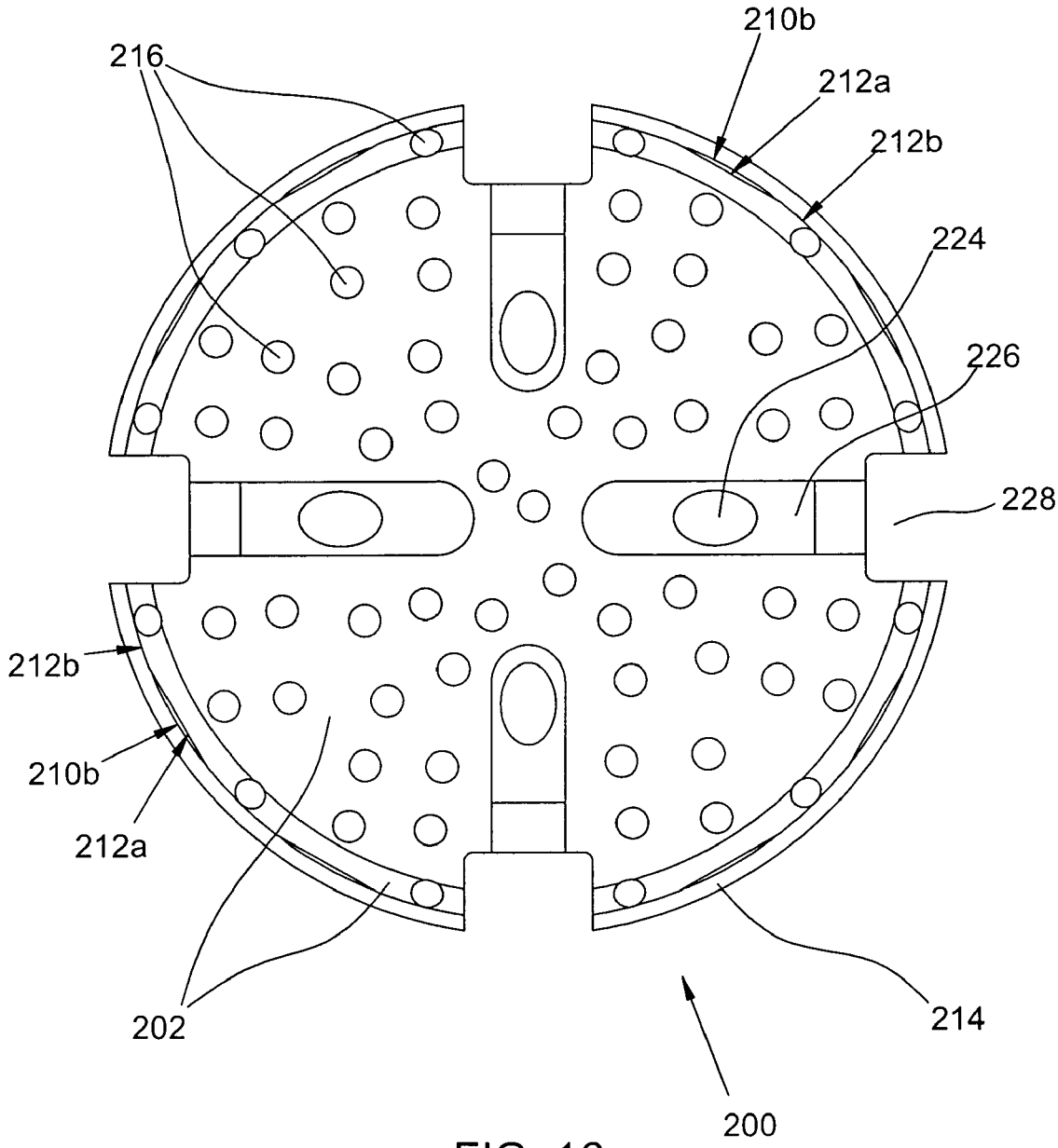
FIG. 16 is a leading end view of a center bit.
Figure 17A:
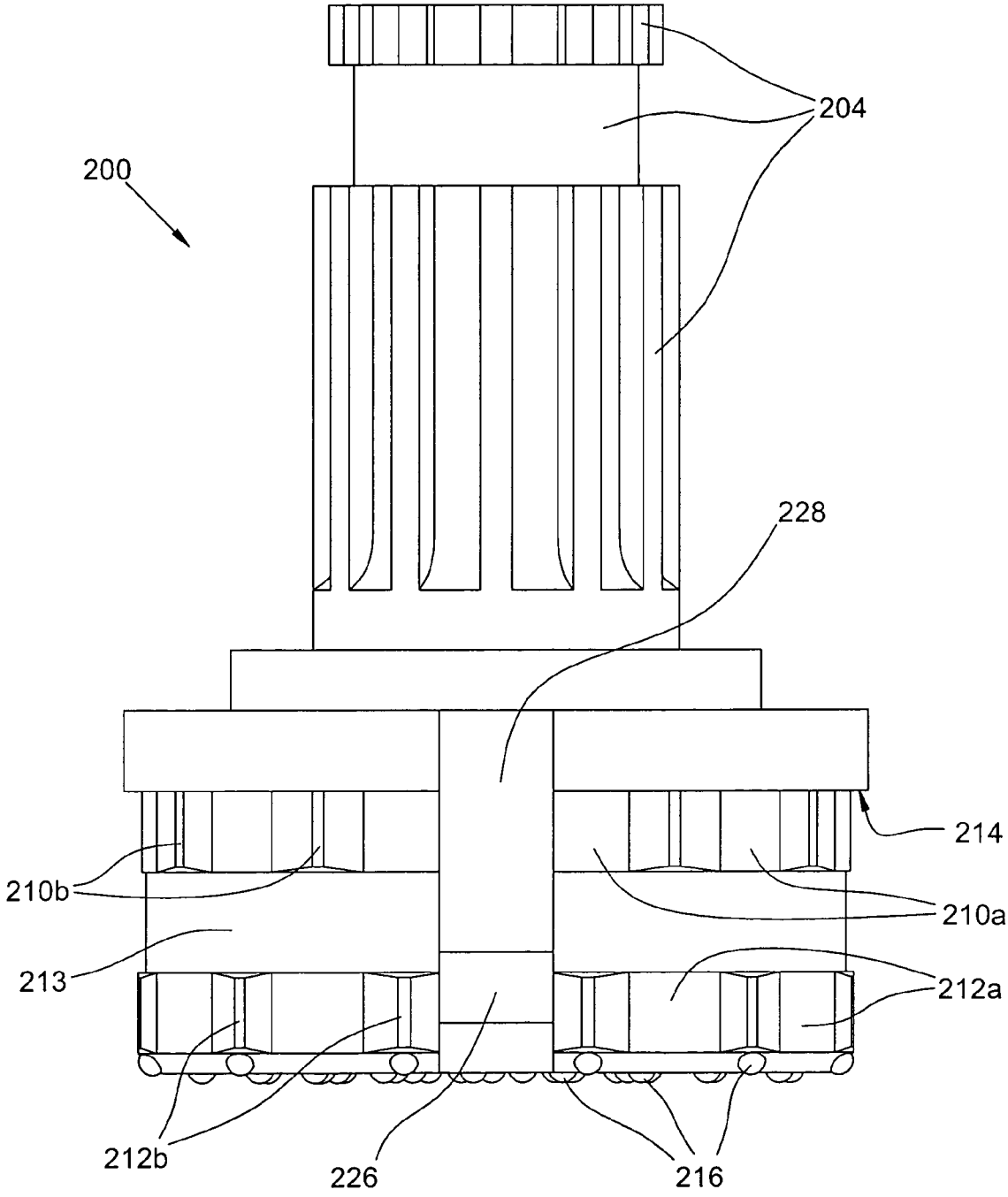
FIGS. 17A–17B are side and cross-sectional views, respectively, of a center bit.
Figure 17B:
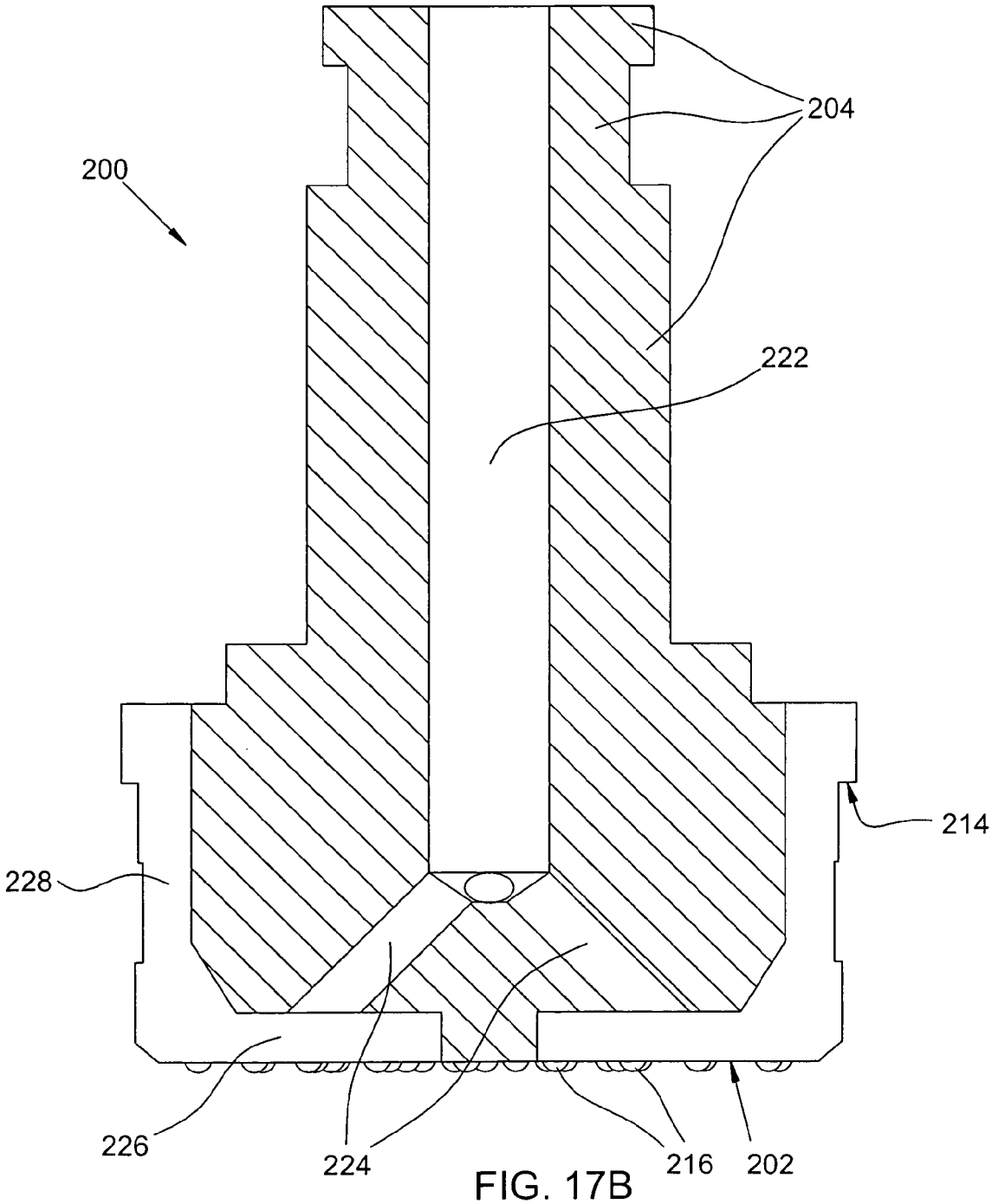
Figure 18:
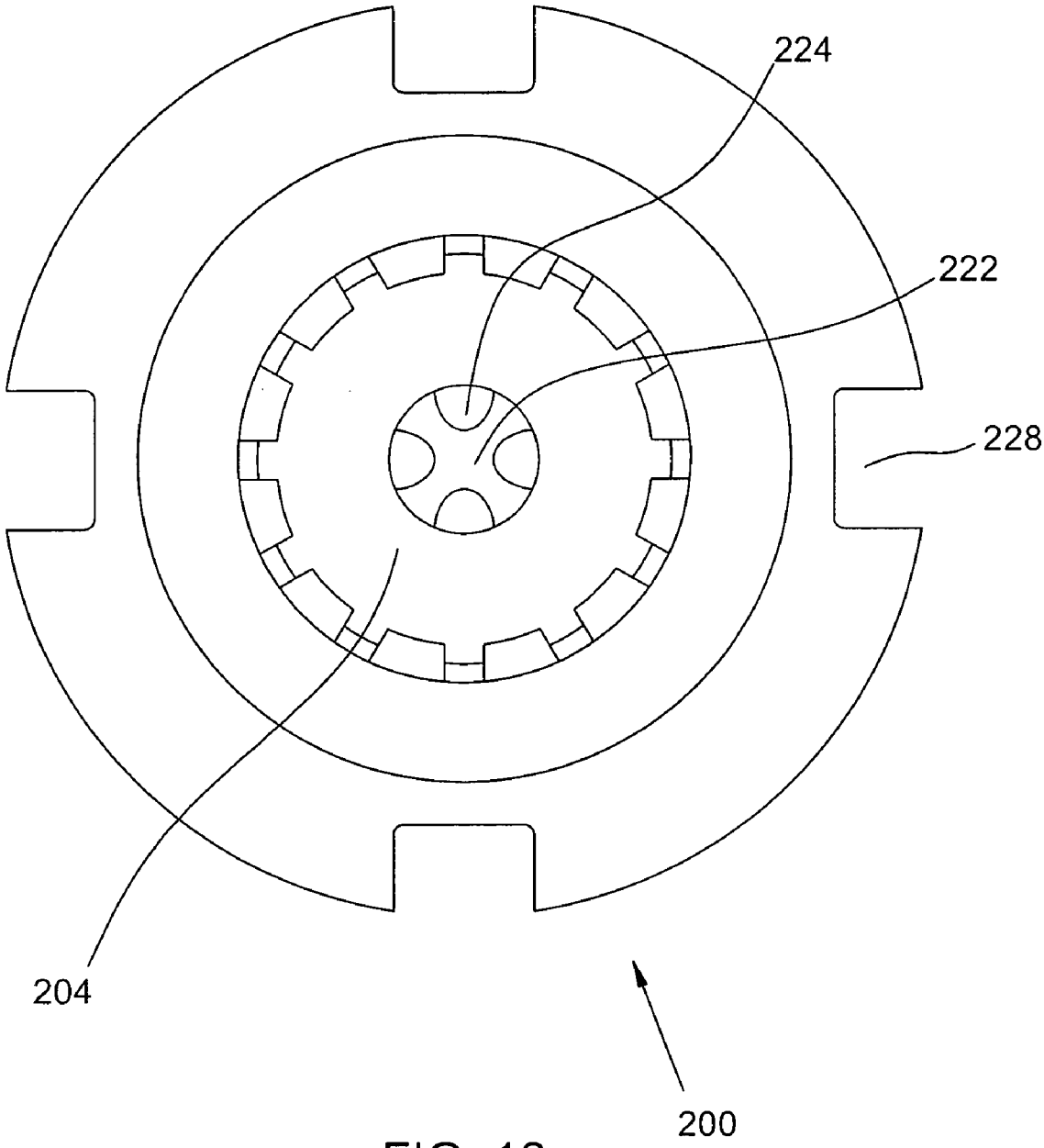
FIG. 18 is a trailing end view of a center bit.

The casing shoe is shown alone in FIGS. 12–14. It comprises a hollow cylinder, sufficiently large at its leading end 302 to receive the trailing end 104 of the ring bit 100, and sufficiently large at its trailing end 304 to receive a leading end 12 of a casing 10. For drilling a hole, casing shoe 300 is substantially rigidly connected to the leading end 12 of the casing 10 in a substantially coaxial arrangement. In the exemplary embodiment, the ring bit 100 is retained by the casing shoe 300 by engagement of mating reverse-angle shoulders 114 (provided on the outer circumferential surface of the ring bit 100) and 314 (provided on the inner circumferential surface of the casing shoe 300). Refer to FIGS. 5A–5D, 10B, and 14B. The reverse-angle shoulders 114/314 serve to transfer to the casing 10 via the casing shoe 300 a percussive impact applied to the ring bit 100. As the hole is drilled and the drill bit assembly is driven into the hole, this transfer of percussive impact from the ring bit 100 to the casing 10 serves to drive the casing into the hole. The reverse angle of the mating shoulders 114/314 urges the casing shoe 300 radially inward when a percussive impact is applied to the ring bit, counteracting the tendency for the casing shoe to distort under the impact and to become separated from the ring bit 100. A longitudinal split 306 in casing shoe 300 enables the ring bit 100 and the casing shoe 300 to be assembled by a press. The split 306 may also facilitate insertion of the leading end 12 of casing 10 into the trailing end 304 of casing shoe 300. The split 306 may be welded or otherwise closed or secured together after the ring bit 100 and casing shoe 300 are assembled (perhaps also after assembly of casing shoe 300 with casing 10). When an impact is applied to ring bit 100, both the ring bit and the casing are driven into the hole. Some clearance may be provided so that the ring bit 100 may move longitudinally relative to the casing shoe 300. After an impact, the ring bit 100 stops first, upon encountering more of the ground formation being drilled. The casing 10 continues to move, until it hits the ring bit 100, thereby yielding a secondary impact on the ring bit. This secondary impact serves to further drive the ring bit into the ground formation, speeding the drilling of the hole. Both the leading end 12 of the casing 10 and the trailing end 104 of the ring bit 100 are received within the casing shoe 300, which may be arranged so that the secondary impact is imparted by contact between the leading end 12 of the casing 10 and the trailing end 104 of the ring bit (FIG. 5D). Clearance between about 0.2 inches and about 0.5 inches, or between about 0.3 inches and about 0.4 inches, may be suitable for generating the secondary impact. The secondary impact may be direct, with the casing 10 striking the ring bit 100, or may be indirect, with the casing 10 striking the casing shoe 300 that in turn strikes the ring bit 100. Direct contact between the casing 10 and the ring bit 100 may result in less stress, wear, and/or deformation of the casing shoe 300 due to the secondary impact.

Center bit 200 is shown alone in FIGS. 15–18. The leading end 202 of center bit 200 is adapted for drilling the center portion of the hole in the ground formation, and may include hardened inserts 216 (tungsten carbide compacts, for example, or any other suitable insert). Center bit 200 is adapted at its trailing end 204 for being rotated and percussively driven; suitable adaptations may include: a shank area that engages a hammer device with splines, keyways, drive pins, and/or other structures suitable for transferring torque from the hammer device to the center bit 200 for rotating the same; and a striking surface for receiving impacts from the piston of the hammer device for percussively driving the center bit. The hammer device may comprise a percussive down hole hammer (pneumatic or fluid percussive), a reverse circulation percussive down hole hammer, or any other drive device suitable for rotating and percussively driving the center bit 200.

The center bit 200 may include a center channel 222, face channels 226, branch channels 224 each connecting the center channel to a corresponding face channel 226, and outer channels 228. The channels enable circulation of fluid into and out of the drilled hole through the channels for removing debris generated by drilling. The fluid may be injected into the casing 10 around the center bit 200 and escape through the center channel 222 (conventional circulation), or may be injected into the center channel 222 and escape from the casing 10 around the center bit 200 (reverse circulation). Any suitable fluid(s) may be employed for circulation and debris removal, including but not limited to: air, water, mud, concrete, or other suitable fluid medium.

The particular arrangement of center bit 200 shown in the Figures (including channels 222/224/226/228, first end 202 and inserts 216, and second end 204) shown in the Figures is exemplary only, and should not be construed as limiting the scope of the present disclosure and/or appended claims; any other suitable arrangement or configuration shall also fall within the scope of the present disclosure and/or appended claims.

The center bit and ring bit are adapted for engaging one another so that rotating and percussively driving the center bit also rotates and percussively drives the ring bit. A drive shoulder 214 provided on the outer circumferential surface of center bit 200 makes contact with the trailing end 104 of the ring bit 100 when the center bit is inserted into the ring bit (FIG. 5D). An impact applied to the center bit 200 is transferred to the ring bit 100 through contact between the shoulder 214 and the trailing edge 104. Any other suitable arrangement may be employed for transferring impact from the center bit to the ring bit, and shall fall within the scope of the present disclosure and/or appended claims.

The outer circumferential surface of the center bit 200 (FIGS. 15–18) comprises a leading circumferential set of alternating flats 212*a* and points 212*b*, and a trailing circumferential set of alternating flats 210*a* and points 210*b*. The two sets are separated longitudinally by a circumferential slot 213, and the points 210*b* of the trailing set are angularly offset relative to the points 212*b* of the leading set. The inner circumferential surface of the ring bit 100 (FIGS. 8–11) comprises a leading circumferential set of alternating flats 112*a* and points 112*b*, and a trailing circumferential set of alternating flats 110*a* and points 110*b*. The two sets are separated longitudinally by a circumferential slot 113, and the points 110*b* of the trailing set are angularly offset relative to the points 112*b* of the leading set. Longitudinal substantial alignment of the leading and trailing sets of flats and points (212*a*/212*b* and 210*a*/210*b*) of the center bit 200 with, respectively, the leading and trailing sets of flats and points (112*a*/112*b* and 110*a*/110*b*) of the ring bit 100 engages the center bit with the ring bit so that rotating the center bit rotates the ring bit (as is FIG. 5D). This engagement nevertheless permits relative longitudinal movement of the center bit and ring bit, thereby permitting the ring bit to be driven independently by the secondary impact imparted by the casing (described above). The center bit 200 and ring bit 100 may be engaged by: i) rotating the center bit to substantially align points 212*b* of the center bit with points 110*b* of the ring bit (FIG. 5A); ii) inserting the center bit into the ring bit until the leading set 212*a*/212*b* of the center bit is longitudinally substantially aligned with the circumferential slot 113 of the ring bit, and until the trailing set 110*a*/110*b* of the ring bit is longitudinally substantially aligned with the circumferential slot 213 of the center bit (FIG. 5B); iii) rotating the center bit to substantially align points 212*b* of the center bit with points 112*b* of the ring bit (FIG. 5C; enabled by the clearance provided by slots 113 and 213); and iv) inserting the center bit into the ring bit until sets 210*a*/210*b* and 212*a*/212*b* of the center bit are longitudinally substantially aligned with, respectively, sets 110*a*/110*b* and 112*a*/112*b* of the ring bit (FIG. 5D).

The center bit 200 and ring bit 100 may be disengaged, and the center bit removed from the ring bit, casing shoe, and casing, by reversing the above procedure. This might be done, for example, upon completion of drilling with the center bit and ring bit if the casing 10 is to remain in the hole in the ground formation (at least temporarily). For example, upon reaching bedrock with the casing 10, the center bit 200 may be disengaged and removed from the casing, and another drill bit (appropriate for rock formations) may be inserted to drill into the bedrock (without advancing the casing). The casing 10 serves to support the hole while the additional drilling is done, and may be removed after such drilling is completed. The casing shoe being outside the casing and ring bit enables a wider range of other drill bits to be advanced through the casing and ring bit for such additional drilling. In another example, the center bit may be removed upon completion of drilling, and the casing 10 (along with ring bit 100 and casing shoe 300) may be left to support the hole while concrete and/or reinforcing members are inserted into the hole. The casing may be withdrawn as the hole fills with concrete. In other instances, it may be desirable for various reasons to leave the casing within the hole permanently, despite the loss of the ring bit and casing shoe that this would entail.

The phrase "flats" and "points" as used in the present disclosure and the appended claims shall be broadly construed. A simple circumferential set of flats and points might be a regular polygon, with the sides of the polygon being the flats and the vertices of the polygon being the points. Corresponding sets on the center bit and ring bit would engage one another when the sides and vertices line up and the center bit could be inserted into the ring bit. The engagement of the interlocking flats and points would substantially prevent relative rotation of the center bit and ring bit, so rotation of the center bit would result in rotation of the rig bit as well, in either rotation direction. Any rotational driving of the center bit also rotationally drives the ring bit when thus engaged. Modified versions of the simple polygonal flats and points are shown in the exemplary embodiment of the Figures, where the vertices of the polygon are rounded off and/or beveled off. The engagement of the center bit and ring bit is essentially unaltered. Any other interlocking configuration, such as a gear-like arrangement, may also fall within the scope of the present disclosure and/or appended claims.

The center bit 200 and ring bit 100 are adapted for engaging one another so that withdrawing the center bit 200 from the hole also withdraws from the hole the ring bit 100, the casing shoe 300, and the casing 10 connected to the casing shoe. The center bit 200 is inserted into the ring bit 100 so that the leading set 212*a*/212*b* of the center bit 200 is longitudinally substantially aligned with the slot 113 of the ring bit 100, while the trailing set 110*a*/110*b* of the ring bit 100 is longitudinally substantially aligned with the slot 213 of the center bit 200. In this alignment, the center bit and ring bit may rotate relative to one another, due to the clearance provided by the slots 113 and 213. The center bit is rotated so that the flats 212*a* are substantially aligned with the points 110*b*, and the points 212*b* are substantially aligned with flats 110*a* (FIG. 5C). When the center bit 200 is withdrawn from the hole, this alignment results in engagement of trailing edges of points 212*b* of the leading set of the center bit 200 with leading edges of flats 110*a* of the trailing set of the ring bit 100. When thus engaged, withdrawal of the center bit from the hole results in withdrawal from the hole of the ring bit 100 casing shoe 300, and casing 10 as well. The center bit 200, ring bit 100, casing shoe 300, and casing 10, when thus engaged, may be only partly withdrawn (i.e. retracted within the hole) during an interruption in the percussive driving of the center bit in order to "work the hole" past an obstruction or difficult area, after which percussive driving and drilling of the hole would continue. The center bit, ring bit, casing shoe, and casing, when thus engaged, may be removed from the hole if drilling is complete and if the casing need not remain in the hole.

It is intended that equivalents of the disclosed exemplary embodiments and methods shall fall within the scope of the present disclosure and/or appended claims. It is intended that the disclosed exemplary embodiments and methods, and equivalents thereof, may be modified while remaining within the scope of the present disclosure and/or appended claims.

What is claimed is:

1. An apparatus, comprising:

a casing shoe adapted for being substantially rigidly connected to a leading end of a casing in a substantially coaxial arrangement, with the leading end of the casing received within a trailing end of the casing shoe;

a ring bit mechanically retained by the casing shoe in a substantially coaxial arrangement with the trailing end of the ring bit received within a leading end of the casing shoe, and rotatable relative to the casing shoe, the ring bit being adapted at its leading end for drilling a peripheral portion of a hole in a ground formation with a hole diameter sufficiently large to accommodate the casing shoe; and a center bit adapted at a leading end thereof for drilling a central portion of the hole in a ground formation, and adapted at a trailing end thereof for being rotated and percussively driven to drill the hole, wherein:

the center bit and ring bit are adapted for engaging one another so that rotating and percussively driving the center bit also rotates and percussively drives the ring bit;

the center bit and ring bit are adapted for engaging one another so that withdrawing the center bit from the hole also withdraws from the hole the ring bit and the casing shoe;

the center bit and ring bit are adapted for enabling disengagement of the center bit from the ring bit and withdrawal of the center bit from the ring bit and the casing shoe; and an outer circumferential surface of the ring bit and an inner circumferential surface of the casing shoe are provided with mating reverse-angle shoulders for transferring to a casing via the casing shoe a percussive impact applied to the ring bit, and for urging the casing shoe radially inward when a percussive impact is applied to the ring bit.

2. The apparatus of claim 1, wherein the casing shoe is longitudinally split for enabling assembly of the casing shoe with the ring bit.

3. An apparatus, comprising:

a casing shoe adapted for being substantially rigidly connected to a leading end of a casing in a substantially coaxial arrangement, with the leading end of the casing received within a trailing end of the casing shoe;

a ring bit mechanically retained by the casing shoe in a substantially coaxial arrangement with the trailing end of the ring bit received within a leading end of the casing shoe, and rotatable relative to the casing shoe, the ring bit being adapted at its leading end for drilling a peripheral portion of a hole in a ground formation with a hole diameter sufficiently large to accommodate the casing shoe; and a center bit adapted at a leading end thereof for drilling a central portion of the hole in a ground formation, and adapted at a trailing end thereof for being rotated and percussively driven to drill the hole, wherein:

the center bit and ring bit are adapted for engaging one another so that rotating and percussively driving the center bit also rotates and percussively drives the ring bit;

the center bit and ring bit are adapted for engaging one another so that withdrawing the center bit from the hole also withdraws from the hole the ring bit and the casing shoe;

the center bit and ring bit are adapted for enabling disengagement of the center bit from the ring bit and withdrawal of the center bit from the ring bit and the casing shoe;

the ring bit translates longitudinally relative to the casing shoe, so that a percussive impact applied to the ring bit may result in a secondary impact on the ring bit; and the secondary impact is imparted by contact between the trailing end of the ring bit and a leading end of a casing connected to the casing shoe.

4. An apparatus, comprising:

a casing shoe adapted for being substantially rigidly connected to a leading end of a casing in a substantially coaxial arrangement, with the leading end of the casing received within a trailing end of the casing shoe;

a ring bit mechanically retained by the casing shoe in a substantially coaxial arrangement with the trailing end of the ring bit received within a leading end of the casing shoe, and rotatable relative to the casing shoe, the ring bit being adapted at its leading end for drilling a peripheral portion of a hole in a ground formation with a hole diameter sufficiently large to accommodate the casing shoe; and a center bit adapted at a leading end thereof for drilling a central portion of the hole in a ground formation, and adapted at a trailing end thereof for being rotated and percussively driven to drill the hole, wherein:

the center bit and ring bit are adapted for engaging one another so that rotating and percussively driving the center bit also rotates and percussively drives the ring bit;

the center bit and ring bit are adapted for engaging one another so that withdrawing the center bit from the hole also withdraws from the hole the ring bit and the casing shoe;

the center bit and ring bit are adapted for enabling disengagement of the center bit from the ring bit and withdrawal of the center bit from the ring bit and the casing shoe;

the outer circumferential surface of the center bit comprises leading and trailing circumferential sets of alternating flats and points longitudinally separated by a circumferential slot, the points of the leading set being angularly offset relative to the points of the trailing set;

the inner circumferential surface of the ring bit comprises leading and trailing circumferential sets of alternating flats and points longitudinally separated by a circumferential slot, the points of the leading set being angularly offset relative to the points of the trailing set; and longitudinal substantial alignment of the leading and trailing sets of flats and points of the center bit with, respectively, the leading and trailing sets of flats and points of the ring bit engages the center bit with the ring bit so that rotating the center bit rotates the ring bit.

5. The apparatus of claim 4, wherein engagement of trailing edges of points of the leading set of flats and points of the center bit with leading edges of flats of the trailing set of flats and points of the ring bit serves to engage the center bit with the ring bit so that withdrawing the center bit from the hole also withdraws from the hole the ring bit, casing shoe, and a casing connected to the casing shoe.

6. The apparatus of claim 4, wherein engagement of trailing edges of points of the leading set of flats and points of the center bit with leading edges of flats of the trailing set of flats and points of the ring bit serves to engage the center bit with the ring bit so that retracting the center bit within the hole also retracts within the hole the ring bit, casing shoe, and a casing connected to the casing shoe.

7. The apparatus of claim 4, wherein the substantially aligned sets of flats and points engage the center bit with the ring bit so that the center bit and the ring bit may rotate together in either direction.

8. The apparatus of claim 4, wherein the center bit may be disengaged from the ring bit by withdrawing the center bit from the ring bit until the leading set of flats and points of the center bit is longitudinally substantially aligned with the circumferential slot of the ring bit and the trailing set of flats and points of the ring bit is longitudinally substantially aligned with the circumferential slot of the center bit, rotating the center bit to substantially align points of the leading set of flats and points of the center bit with points of the trailing set of flats and points of the ring bit, and withdrawing the center bit from the ring bit.

9. The apparatus of claim 4, wherein the center bit and the ring bit are adapted to be engaged by:

rotating the center bit to substantially align points of the leading set of flats and points of the center bit with points of the trailing set of flats and points of the ring bit;

inserting the center bit into the ring bit until the leading set of flats and points of the center bit is longitudinally substantially aligned with the circumferential slot of the ring bit and the trailing set of flats and points of the ring bit is longitudinally substantially aligned with the circumferential slot of the center bit;

rotating the center bit to substantially align points of the leading set of flats and points of the center bit with points of the leading set of flats and points of the ring bit; and inserting the center bit into the ring bit until the leading and trailing sets of flats and points of the center bit are longitudinally substantially aligned with, respectively, the leading and trailing sets of flats and points of the ring bit.

10. An apparatus, comprising:

a casing shoe adapted for being substantially rigidly connected to a leading end of a casing in a substantially coaxial arrangement, with the leading end of the casing received within a trailing end of the casing shoe;

a ring bit mechanically retained by the casing shoe in a substantially coaxial arrangement with the trailing end of the ring bit received within a leading end of the casing shoe, and rotatable relative to the casing shoe, the ring bit being adapted at its leading end for drilling a peripheral portion of a hole in a ground formation with a hole diameter sufficiently large to accommodate the casing shoe; and a center bit adapted at a leading end thereof for drilling a central portion of the hole in a ground formation, and adapted at a trailing end thereof for being rotated and percussively driven to drill the hole, wherein:

the center bit is provided with a central channel, multiple face channels on the leading end, multiple branch channels each connecting the central channel to a corresponding one of the face channels, and multiple longitudinal channels on the outer circumferential surface each connected to a corresponding one of the face channels, thereby enabling circulation of fluid through the channels for removing debris generated by drilling the hole.

an outer circumferential surface of the ring bit and an inner circumferential surface of the casing shoe are provided with mating reverse-angle shoulders for transferring to a casing via the casing shoe a percussive impact applied to the ring bit, and for urging the casing shoe radially inward when a percussive impact is applied to the ring bit;

the casing shoe is longitudinally split for enabling assembly of the casing shoe with the ring bit;

the ring bit translates longitudinally relative to the casing shoe, so that a percussive impact applied to the ring bit may result in a secondary impact on the ring bit that is imparted by contact between the trailing end of the ring bit and a leading end of a casing connected to the casing shoe;

the outer circumferential surface of the center bit is provided with a shoulder for transferring to the ring bit a percussive impact applied to the center bit;

the outer circumferential surface of the center bit comprises leading and trailing circumferential sets of alternating flats and points longitudinally separated by a circumferential slot, the points of the leading set being angularly offset relative to the points of the trailing set;

the inner circumferential surface of the ring bit comprises leading and trailing circumferential sets of alternating flats and points longitudinally separated by a circumferential slot, the points of the leading set being angularly offset relative to the points of the trailing set;

longitudinal substantial alignment of the leading and trailing sets of flats and points of the center bit with, respectively, the leading and trailing sets of flats and points of the ring bit engages the center bit with the ring bit so that rotating the center bit rotates the ring bit, and so that the center bit and the ring bit may rotate together in either direction;

engagement of trailing edges of points of the leading set of flats and points of the center bit with leading edges of flats of the trailing set of flats and points of the ring bit serves to engage the center bit with the ring bit so that withdrawing the center bit from the hole also withdraws from the hole the ring bit, casing shoe, and a casing connected to the casing shoe;

engagement of trailing edges of points of the leading set of flats and points of the center bit with leading edges of flats of the trailing set of flats and points of the ring bit serves to engage the center bit with the ring bit so that retracting the center bit within the hole also retracts within the hole the ring bit, casing shoe, and a casing connected to the casing shoe;

the center bit may be disengaged from the ring bit by withdrawing the center bit from the ring bit until the leading set of flats and points of the center bit is longitudinally substantially aligned with the circumferential slot of the ring bit and the trailing set of flats and points of the ring bit is longitudinally substantially aligned with the circumferential slot of the center bit, rotating the center bit to substantially align points of the leading set of flats and points of the center bit with points of the trailing set of flats and points of the ring bit, and withdrawing the center bit from the ring bit; and the center bit and the ring bit are adapted to be engaged by i) rotating the center bit to substantially align points of the leading set of flats and points of the center bit with points of the trailing set of flats and points of the ring bit;

ii) inserting the center bit into the ring bit until the leading set of flats and points of the center bit is longitudinally substantially aligned with the circumferential slot of the ring bit and the trailing set of flats and points of the ring bit is longitudinally substantially aligned with the circumferential slot of the center bit;

iii) rotating the center bit to substantially align points of the leading set of flats and points of the center bit with points of the leading set of flats and points of the ring bit; and iv) inserting the center bit into the ring bit until the leading and trailing sets of flats and points of the center bit are longitudinally substantially aligned with, respectively, the leading and trailing sets of flats and points of the ring bit.

11. A method for drilling a hole in a ground formation, comprising:

i) substantially aligning at a desired hole position a casing assembly comprising a) an elongated casing, b) a casing shoe substantially rigidly connected to a leading end of the casing in a substantially coaxial arrangement, with the leading end of the casing received within a trailing end of the casing shoe, and c) a ring bit mechanically retained at the leading end of the casing in a substantially coaxial arrangement with the trailing end of the ring bit received within a leading end of the casing shoe, and rotatable relative to the casing shoe, the ring bit being adapted at its first end for drilling a peripheral portion of a hole in a ground formation with a hole diameter sufficiently large to accommodate the casing;

ii) inserting a center bit through the casing and into the ring bit;

iii) engaging the center bit and ring bit so that rotating and percussively driving the center bit also rotates and percussively drives the ring bit; and iv) rotating and percussively driving the center bit and the ring bit engaged therewith, thereby drilling the hole in the ground formation and driving the center bit, ring bit, casing shoe, and casing into the hole, wherein an outer circumferential surface of the ring bit and an inner circumferential surface of the casing shoe are provided with mating reverse-angle shoulders for transferring to the casing via the casing shoe a percussive impact applied to the ring bit, and for urging the casing shoe radially inward when a percussive impact is applied to the ring bit.

12. The method of claim 11, wherein the casing shoe is longitudinally split for enabling assembly of the casing shoe with the ring bit.

13. The method of claim 11, further comprising:

disengaging the center bit from the ring bit; and withdrawing the disengaged center bit from the hole and from the casing, while leaving the casing, the casing shoe, and the ring bit in the hole.

14. The method of claim 11, further comprising:

engaging the center bit with the ring bit so that withdrawing the center bit from the hole also withdraws the ring bit, casing shoe, and casing from the hole; and removing the center bit from the hole, thereby also removing from the hole the engaged ring bit, the casing shoe, and the casing.

15. The method of claim 11, further comprising:

interrupting percussive driving of the center bit before completion of the hole;

during the interruption, engaging the center bit with the ring bit so that retracting the center bit within the hole also retracts the ring bit, casing shoe, and casing from the hole;

during the interruption, retracting the center bit within the hole, thereby also retracting the engaged ring bit, the casing shoe, and the casing; and resuming percussive driving of the center bit.

16. A method for drilling a hole in a ground formation, comprising:

i) substantially aligning at a desired hole position a casing assembly comprising a) an elongated casing, b) a casing shoe substantially rigidly connected to a leading end of the casing in a substantially coaxial arrangement, with the leading end of the casing received within a trailing end of the casing shoe, and c) a ring bit mechanically retained at the leading end of the casing in a substantially coaxial arrangement with the trailing end of the ring bit received within a leading end of the casing shoe, and rotatable relative to the casing shoe, the ring bit being adapted at its first end for drilling a peripheral portion of a hole in a ground formation with a hole diameter sufficiently large to accommodate the casing;

ii) inserting a center bit through the casing and into the ring bit;

iii) engaging the center bit and ring bit so that rotating and percussively driving the center bit also rotates and percussively drives the ring bit; and iv) rotating and percussively driving the center bit and the ring bit engaged therewith, thereby drilling the hole in the ground formation and driving the center bit, ring bit, casing shoe, and casing into the hole, wherein:

the ring bit translates longitudinally relative to the casing, so that a percussive impact applied to the ring bit may result in a secondary impact of the casing on the ring bit; and the secondary impact is imparted by contact between the leading end of the casing and the trailing end of the ring bit.

17. The method of claim 16, further comprising:

disengaging the center bit from the ring bit; and withdrawing the disengaged center bit from the hole and from the casing, while leaving the casing, the casing shoe, and the ring bit in the hole.

18. The method of claim 16, further comprising:

engaging the center bit with the ring bit so that withdrawing the center bit from the hole also withdraws the ring bit, casing shoe, and casing from the hole; and removing the center bit from the hole, thereby also removing from the hole the engaged ring bit, the casing shoe, and the casing.

19. The method of claim 16, further comprising:

interrupting percussive driving of the center bit before completion of the hole;

during the interruption, engaging the center bit with the ring bit so that retracting the center bit within the hole also retracts the ring bit, casing shoe, and casing from the hole;

during the interruption, retracting the center bit within the hole, thereby also retracting the engaged ring bit, the casing shoe, and the casing; and resuming percussive driving of the center bit.

20. A method for drilling a hole in a ground formation, comprising:

i) substantially aligning at a desired hole position a casing assembly comprising a) an elongated casing, b) a casing shoe substantially rigidly connected to a leading end of the casing in a substantially coaxial arrangement, with the leading end of the casing received within a trailing end of the casing shoe, and c) a ring bit mechanically retained at the leading end of the casing in a substantially coaxial arrangement with the trailing end of the ring bit received within a leading end of the casing shoe, and rotatable relative to the casing shoe, the ring bit being adapted at its first end for drilling a peripheral portion of a hole in a ground formation with a hole diameter sufficiently large to accommodate the casing;

ii) inserting a center bit through the casing and into the ring bit;

iii) engaging the center bit and ring bit so that rotating and percussively driving the center bit also rotates and percussively drives the ring bit; and iv) rotating and percussively driving the center bit and the ring bit engaged therewith, thereby drilling the hole in the ground formation and driving the center bit, ring bit, casing shoe, and casing into the hole, wherein:

the outer circumferential surface of the center bit comprises leading and trailing circumferential sets of alternating flats and points longitudinally separated by a circumferential slot, the points of the leading set being angularly offset relative to the points of the trailing set;

the inner circumferential surface of the ring bit comprises leading and trailing circumferential sets of alternating flats and points longitudinally separated by a circumferential slot, the points of the leading set being angularly offset relative to the points of the trailing set; and longitudinal substantial alignment of the leading and trailing sets of flats and points of the center bit with the leading and trailing sets, respectively, of flats and points of the ring bit engages the center bit with the ring bit so that rotating the center bit rotates the ring bit.

21. The method of claim 20, further comprising:

engaging trailing edges of the points of the leading set of flats and points of the center bit with leading edges of the flats of the trailing set of flats and points of the ring bit, thereby engaging the center bit with the ring bit so that withdrawing the center bit from the hole also withdraws the ring bit, casing shoe, and casing from the hole; and removing the center bit from the hole, thereby also removing from the hole the engaged ring bit, the casing shoe, and the casing.

22. The method of claim 20, further comprising:

interrupting percussive driving of the center bit before completion of the hole;

during the interruption, engaging trailing edges of the points of the leading set of flats and points of the center bit with leading edges of the flats of the trailing set of flats and points of the ring bit, thereby engaging the center bit with the ring bit so that retracting the center bit within the hole also retracts the ring bit, casing shoe, and casing within the hole;

during the interruption, retracting the center bit within the hole, thereby also retracting within the hole the engaged ring bit, the casing shoe, and the casing; and resuming percussive driving of the center bit.

23. The method of claim 20, wherein the substantially aligned sets of flats and points engage the center bit with the ring bit so that the center bit and the ring bit may rotate together in either direction.

24. The method of claim 20, further comprising:

withdrawing the center bit from the ring bit until the leading set of flats and points of the center bit is longitudinally substantially aligned with the circumferential slot of the ring bit and the trailing set of flats and points of the ring bit is longitudinally substantially aligned with the circumferential slot of the center bit;

rotating the center bit to substantially align points of the leading set of flats and points of the center bit with points of the trailing set of flats and points of the ring bit;

withdrawing the center bit from the ring bit, thereby disengaging the center bit from the ring bit; and withdrawing the disengaged center bit from the hole and from the casing, while leaving the casing, the casing shoe, and the ring bit in the hole.

25. The method of claim 20, wherein engaging the center bit and the ring bit comprises:

rotating the center bit to substantially align points of the leading set of flats and points of the center bit with points of the trailing set of flats and points of the ring bit;

inserting the center bit into the ring bit until the leading set of flats and points of the center bit is longitudinally substantially aligned with the circumferential slot of the ring bit and the trailing set of flats and points of the ring bit is longitudinally substantially aligned with the circumferential slot of the center bit;

rotating the center bit to substantially align points of the leading set of flats and points of the center bit with points of the leading set of flats and points of the ring bit; and inserting the center bit into the ring bit until the leading and trailing sets of flats and points of the center bit are longitudinally substantially aligned with, respectively, the leading and trailing sets of flats and points of the ring bit.

26. The method of claim 20, further comprising:

disengaging the center bit from the ring bit; and withdrawing the disengaged center bit from the hole and from the casing, while leaving the casing, the casing shoe, and the ring bit in the hole.

27. The method of claim 20, further comprising:

engaging the center bit with the ring bit so that withdrawing the center bit from the hole also withdraws the ring bit, casing shoe, and casing from the hole; and removing the center bit from the hole, thereby also removing from the hole the engaged ring bit, the casing shoe, and the casing.

28. The method of claim 20, further comprising:

interrupting percussive driving of the center bit before completion of the hole;

during the interruption, engaging the center bit with the ring bit so that retracting the center bit within the hole also retracts the ring bit, casing shoe, and casing from the hole;

during the interruption, retracting the center bit within the hole, thereby also retracting the engaged ring bit, the casing shoe, and the casing; and resuming percussive driving of the center bit.

* * * * *